US006750999B1

(12) United States Patent
Chiao

(10) Patent No.: US 6,750,999 B1
(45) Date of Patent: Jun. 15, 2004

(54) RECONFIGURABLE QUASI-OPTICAL UNIT CELLS

(75) Inventor: Jung-Chih Chiao, 2701 Big Oaks Dr., Garland, TX (US) 75044

(73) Assignee: Jung-Chih Chiao, Grand Prairie, TX (US)

( * ) Notice: Subject to any disclaimer, the term of this patent is extended or adjusted under 35 U.S.C. 154(b) by 0 days.

(21) Appl. No.: 10/009,984

(22) PCT Filed: Jun. 9, 2000

(86) PCT No.: PCT/US00/16024

§ 371 (c)(1),
(2), (4) Date: Dec. 11, 2001

(87) PCT Pub. No.: WO00/77543

PCT Pub. Date: Dec. 21, 2000

Related U.S. Application Data

(60) Provisional application No. 60/138,865, filed on Jun. 11, 1999, and provisional application No. 60/173,659, filed on Dec. 30, 1999.

(51) Int. Cl.[7] ..... G02B 26/00; G02B 26/02; G02F 1/01; G02F 1/03; G02F 1/29; H02K 33/00; H02K 5/16; H01L 29/82; G01P 15/00; G01P 15/08

(52) U.S. Cl. ..... 359/237; 359/290; 359/291; 359/279; 359/238; 359/245; 359/248; 359/299; 359/295; 359/316; 359/320; 359/230; 359/231; 310/36; 310/90; 257/418; 257/420; 73/504.09; 73/514.17

(58) Field of Search ..... 359/290, 291, 359/279, 238, 237, 230, 231, 320, 316, 295, 248, 245, 299; 310/36, 90; 257/418, 420; 73/504.09, 514.17; 349/24; 342/372, 179; 372/28; 343/778; 333/81 B

(56) References Cited

U.S. PATENT DOCUMENTS

| | | | | | |
|---|---|---|---|---|---|
| 3,574,438 | A | * | 4/1971 | Carson | 333/81 B |
| 3,576,579 | A | * | 4/1971 | Appelbaum | 343/778 |
| 4,998,255 | A | * | 3/1991 | Gerstenberger et al. | 372/28 |
| 5,071,253 | A | * | 12/1991 | Chase | 359/245 |
| 5,122,894 | A | * | 6/1992 | Grantham | 359/245 |
| 5,170,169 | A | * | 12/1992 | Stephan | 342/179 |
| 5,191,339 | A | * | 3/1993 | Riza | 342/372 |
| 5,373,393 | A | * | 12/1994 | DeJule et al. | 359/320 |
| 5,477,350 | A | * | 12/1995 | Riza et al. | 349/24 |

* cited by examiner

*Primary Examiner*—Georgia Epps
*Assistant Examiner*—Jack Dinh
(74) *Attorney, Agent, or Firm*—Dorsey & Whitney LLP

(57) ABSTRACT

A quasi-optical system is provided. More specifically, a quasi-optical system is provided comprising various embodiments of quasi-optical grids (such as arrays or layers and the like) with reconfigurable quasi-optical unit cells. The quasi-optical system, grids and unit cells are configured to control an incident beam in a variety of ways.

9 Claims, 14 Drawing Sheets

RECONFIGURABLE QUASI-OPTICAL UNIT CELLS

CROSS REFERENCE TO RELATED APPLICATIONS

This application claims the benefit of Provisional application Ser. Nos. 60/138,865, filed Jan. 11, 1999, and 60/173,659, filed Dec. 30, 1999.

This patent application is related to copending PCT patent applications Ser. Nos. PCT/US00/16021 and PCT/US00/16023 having respective attorney docket nos. FP-68000/JAS/SMK and FP-68677/JAS/SMK, with respective titled MEMS TRANSMISSION AND CIRCUIT COMPONENTS and MEMS OPTICAL COMPONENTS, and filed on Jun. 9, 2000. These copending applications are hereby incorporated by reference.

TECHNICAL FIELD OF THE INVENTION

The present invention relates generally to quasi-optical systems. In particular, the present invention pertains to a quasi-optical system comprising quasi-optical grids (i.e., arrays or layers) with reconfigurable quasi-optical unit cells.

BACKGROUND OF THE INVENTION

To accommodate bandwidth and resolution demands, future communication networks are likely to migrate toward operating frequencies at corresponding millimeter and sub-millimeter wavelengths. In the past, the lack of high-frequency semiconductor devices has prevented the development of such high-frequency systems. However, recent advances in semiconductor device technology have allowed integrated circuits to operate at as high as 300 GHz for transistors and 1.0 THz for diodes. In any working system, transmitters must be capable of efficiently providing sufficient power and the receivers must be able to handle signals of widely varying strength without sacrificing sensitivity. It seems exceedingly difficult to meet these demands using conventional microwave power-combining techniques.

One promising approach for realizing millimeter and sub-millimeter wavelength high power systems is quasi-optical power combining This is an elegant technique to integrate many active devices into a free-space power combining component. Hundreds, possibly thousands, of solid-state high speed devices could be incorporated through wafer scale integration to generate high power. Quasi-optical wireless systems are particularly attractive because they allow the front-end components to be inexpensively mass produced and they don't require single mode waveguides, thereby allowing higher operating frequencies.

One of the key components in a complete quasi-optical system is the beam controller. The beam controller is used to control a beam by steering, focusing, splitting, switching, and/or shaping the beam. For example, the beam controller is used in systems employing radar for aircraft guidance, missile seeking, and automobile collision avoidance. Similarly, the beam controller is necessary in a millimeter wavelength imaging camera that sees through fog. In these systems, high speed control of a beam is necessary so that more targets can be tracked or imaged simultaneously.

In the past, beam switching has been demonstrated with beam switches comprising grids with PIN diodes. However, the configuration of the grids prevents them from being used to steer, focus, and/or shape beams.

Furthermore, beam controllers comprising grids with Schottky diodes have also been developed in the past for reflective steering of beams. However, the series resistance of the Schottky diodes increases when the operating frequencies increase. This causes significant reflection losses and prevents these beam controllers from being used at shorter wavelengths for a low loss system.

Therefore, there is a need for a quasi-optical beam controller that can efficiently operate at millimeter and sub-millimeter wavelengths without significant losses. Such a beam controller would ideally provide transmission type steering, focusing, and/or shaping of beams.

SUMMARY OF THE INVENTION

In summary, the present invention comprises various embodiments for a quasi-optical system, a quasi-optical grid for use in the quasi-optical system, and a quasi-optical unit cell for use in the quasi-optical grid. The quasi-optical system, grid, and unit cell are used to control an incident beam.

In one embodiment, the quasi-optical unit cell comprises an inductive conductive strip configured to provide an inductive reactance and capacitive conductive strips to provide a capacitive reactance. In this embodiment, at least one of the inductive strip and the capacitive strips are controllably reconfigurable by a control circuit of the quasi-optical system to provide the unit cell with a variable overall reactance for producing a variable phase shift in the incident beam.

In another embodiment, the quasi-optical unit cell comprises an inductive conductive strip configured to provide an inductive reactance, capacitive conductive strips configured to provide a capacitive reactance, and a switch configured to provide a switching function. In this embodiment, the unit cell has an overall reactance in which the inductive reactance and the switching function are in series with each other and in parallel with the capacitive reactance. Thus, the overall reactance is primarily inductive or primarily capacitive when the switch is controlled by a control circuit of the quasi-optical system so that the switching function is on or off. The inductive and capacitive strips are configured so that the overall reactance causes a phase shift in but not an amplitude distortion in the incident beam.

In still another embodiment, the quasi-optical unit cell comprises a substrate having opposite first and second sides, a first dielectric layer on the first side of the substrate, a second dielectric layer on the second side of the substrate, an inductive conductive strip on the first dielectric layer that is configured to provide an inductive reactance, capacitive conductive strips on the second dielectric layer configured to provide a capacitive reactance, and a switch on the first dielectric layer that is configured to provide a switching function. The unit cell has an overall reactance in which the inductive reactance and the switching function are in series with each other and in parallel with the capacitive reactance. The overall reactance is primarily inductive or primarily capacitive when the switch is controlled so that the switching function is on or off.

DETAILED DESCRIPTION OF THE INVENTION

Figure 1:
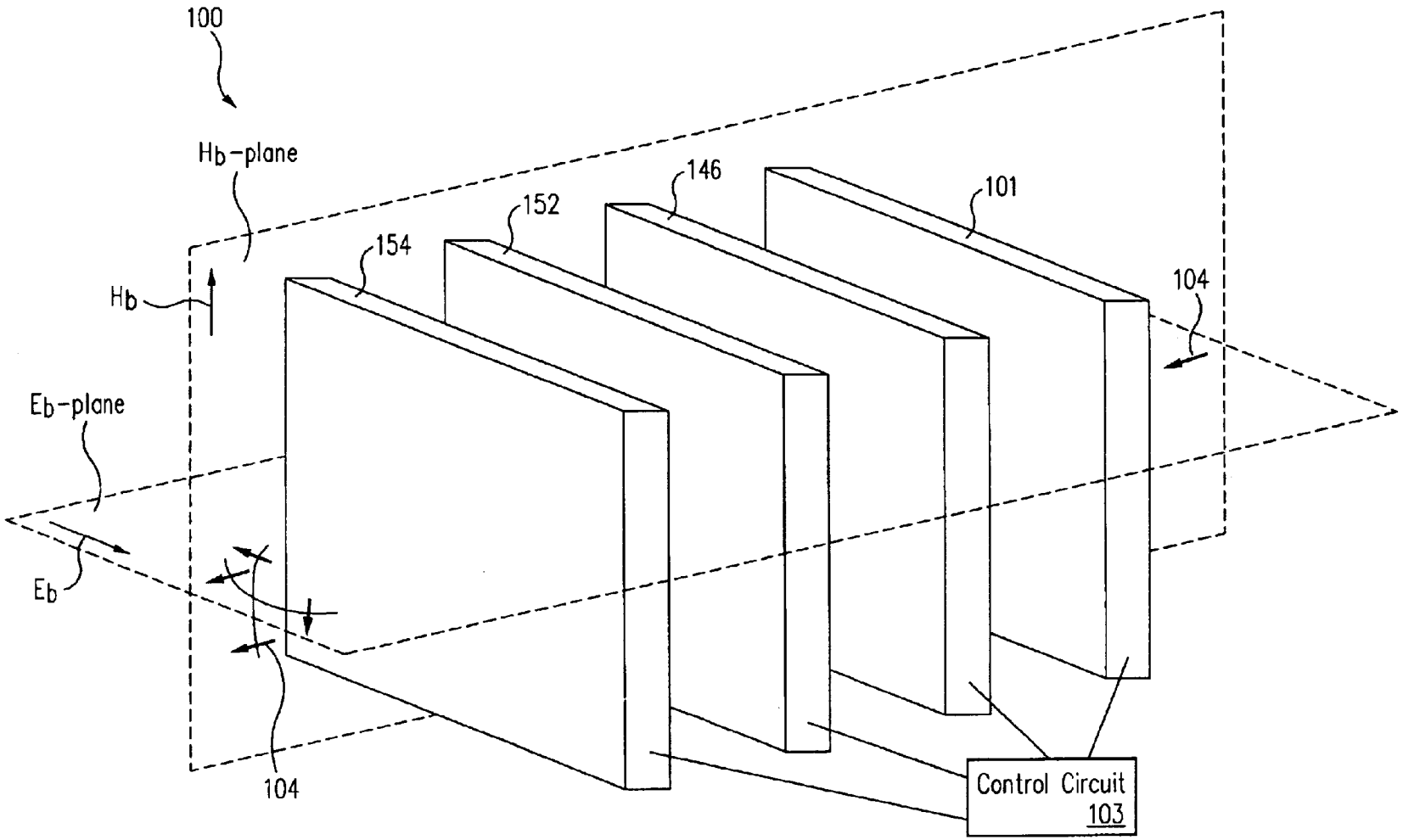
FIG. 1 shows one configuration for a quasi-optical system, namely a quasi-optical beam controller, in accordance with the present invention.

Referring to FIG. 1, there is shown a configuration of one type of quasi-optical system, namely a quasi-optical beam controller 100, according to the present invention. The beam controller 100 comprises quasi-optical grids (i.e., arrays or layers) 101, 146, 152 and/or 154 and a control circuit 103. The grids 101, 146, 152 and/or 154 are stacked in parallel and spaced at quarter wavelengths. A beam 104 radiating in free space enters the beam controller 100 and passes through the grids 101. The grids 101, 146, 152 and/or 154 control the beam 104 under the control of the control circuit 103. This control of the beam 104 may include any combination of steering, focusing, splitting, switching, shaping, and/or some other type of altering of the beam 104. The beam 104 then exits the beam controller 100 and radiates back into free space.

The grids 101, 146, 152 and/or 154 are used to control the beam 104 in the corresponding propagation plane of its electric field (hereafter "$E_b$-plane") and/or the corresponding propagation plane of its magnetic field $H_b$ (hereafter "$H_b$-plane"). In doing so, each grid 101, 146, 152 and/or 154 is controlled by the control circuit 103 to causes a corresponding phase shift in the beam 104 in the $E_b$-plane and/or $H_b$-plane. In this way, the total phase shift in the $E_b$-plane and/or $H_B$-plane that occurs across the grids 101, 146, 152 and/or 154 comprises progressive phase shifts and provides the overall control of the beam 104 in the $E_b$-plane and/or $H_b$-plane.

As those skilled in the art will appreciate, the number and the type of grids 101, 146, 152 and/or 154 used in the beam controller 100 will depend on the amount and type of control of the beam 104 that is desired. Thus, the beam controller 100 could include any combination of one or more grids 101, 146, 152 and/or 154 for controlling the beam 104 in its $E_b$-plane and/or $H_b$-plane simultaneously and/or separately. Grids 101

Figure 2:
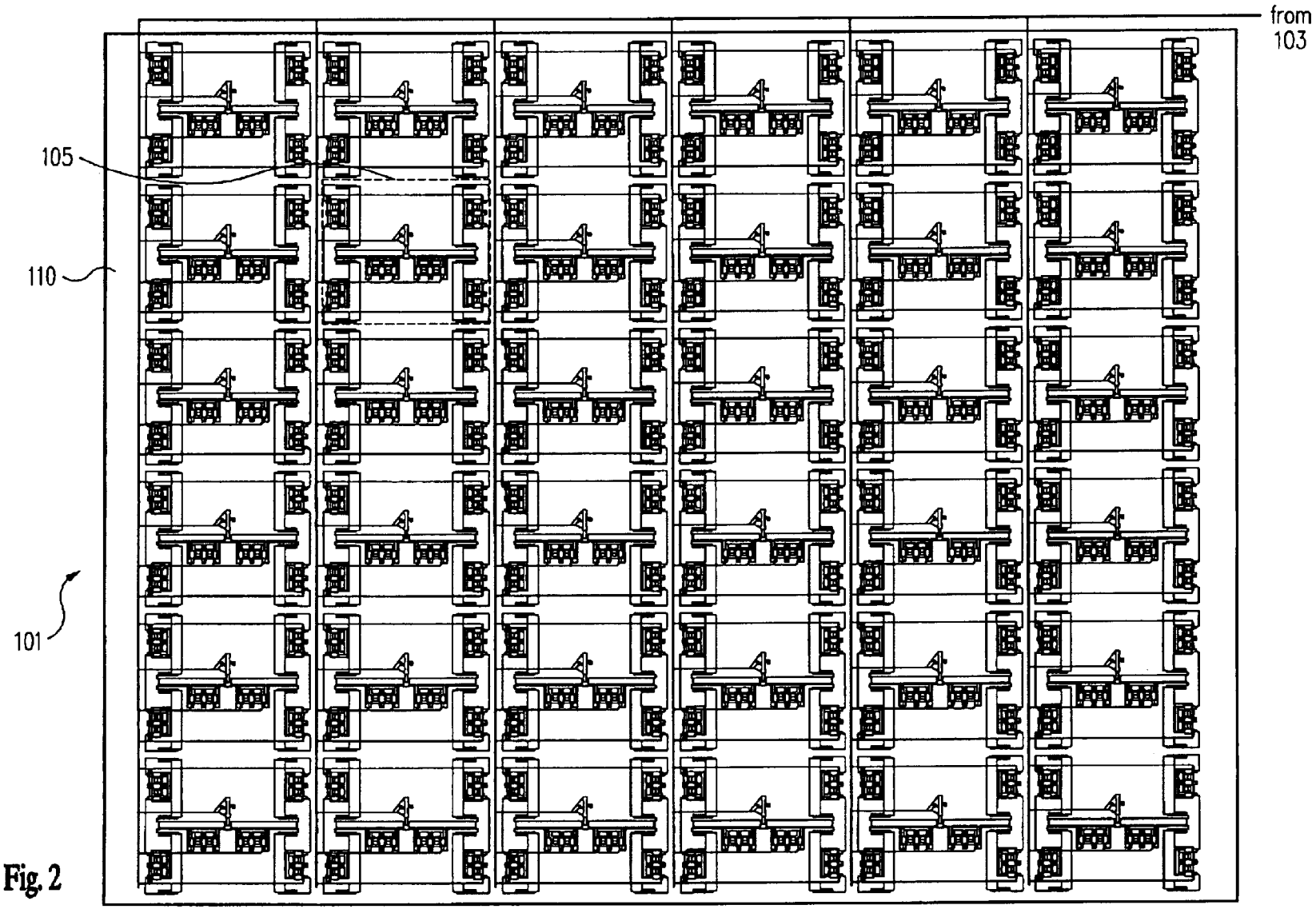
FIG. 2 shows a quasi-optical grid that can be used in the beam controller of FIG. 1.

Referring to FIG. 2, each of the grids 101 comprises reconfigurable unit cells 105. The unit cells 105 of each grid 101 are integrally formed together in a configuration to produce beam control in the $E_b$-plane and/or $H_b$-plane of the beam 104 of FIG. 1.

Figure 3:
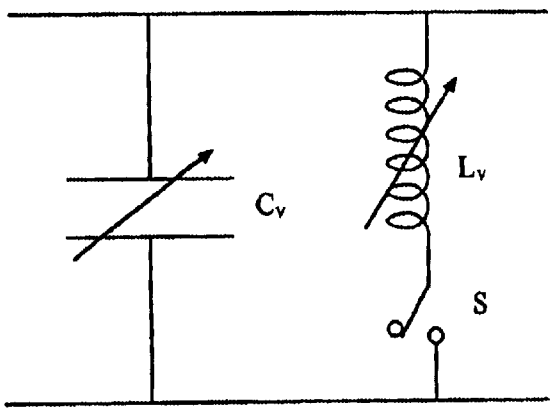
FIG. 3 shows the equivalent circuit of each quasi-optical unit cell of the grid of FIG. 2.

Each unit cell 105 is controllably reconfigurable by the control circuit 103 of FIG. 1 to have a variable overall reactance for producing a corresponding variable unit wide phase shift in the beam 104 of FIG. 1 in the $E_b$-plane or $H_b$-plane. By reconfiguring each unit cell 105 to have a selected overall reactance, a corresponding selected unit wide phase shift in the $E_b$-plane or $H_b$-plane is achieved with the unit cell 105. Each grid 101 can therefore provide a selected discrete phase shaft in the $E_b$-plane and/or $H_b$-plane by controllably reconfiguring the unit cells 105 of the grid 101 to have various selected overall reactances. In this way, if multiple grids 101 are used in the beam controller of FIG. 1, the total phase shift in the $E_b$-plane and/or $H_b$-plane that occurs across the grids 101 comprises progressive discrete phase shifts. FIG. 3 shows the equivalent circuit of each unit cell 105. To provide the overall variable reactance, each unit cell 105 has a shunt variable inductive reactance $L_v$, a shunt variable capacitive reactance $C_v$, and a switching function S. The switching function S is electrically connected in series with the inductive reactance $L_v$. The capacitive reactance $C_v$ is electrically connected in parallel with the in series electrical connection of the inductive reactance $L_v$ and the switching function S. The overall reactance of the unit cell 105 can be varied by appropriately turning on or off the switching function S and/or by varying the inductive reactance $L_v$ and/or the capacitive reactance $C_v$.

Figure 4:
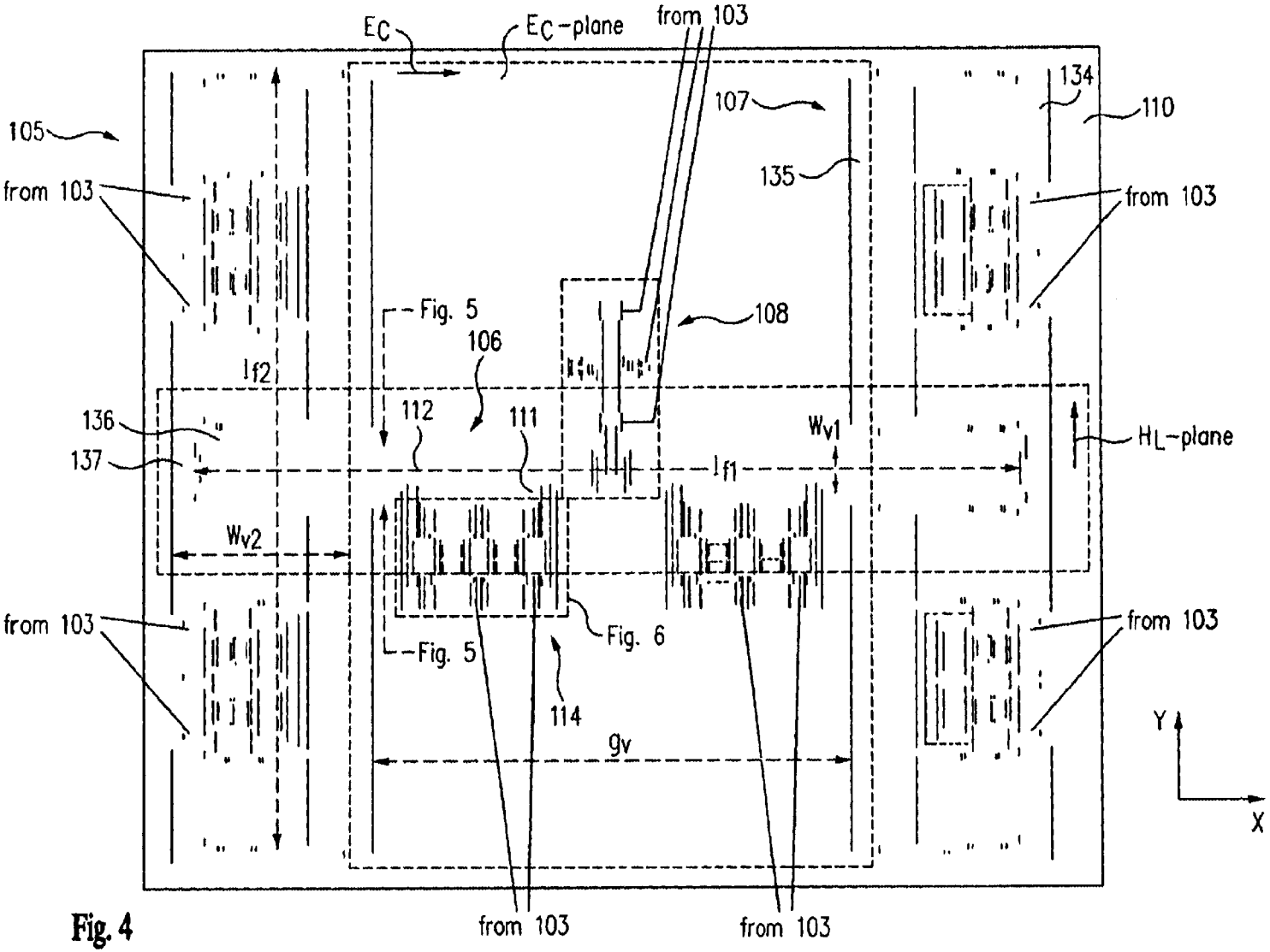
FIG. 4 shows one configuration for each unit cell of FIG. 2 in order to implement the equivalent circuit of FIG. 3.

FIG. 4 shows one possible configuration for each unit cell 105 to provide the equivalent circuit of FIG. 3. Each unit cell 105 comprises a MEMS (micro-machined electromechanical systems) reconfigurable inductive conductive strip 106 and two parallel MEMS reconfigurable capacitive conductive strips 107, and a MEMS see-saw switch 108. As shown in FIGS. 5 to 11, each unit cell 105 also comprises a corresponding portion of the semiconductor substrate 109 and dielectric layer 110 of the corresponding grid 101 of FIG. 2. The reconfigurable inductive and capacitive strips 106 and 107 and the switch 108 are formed on the dielectric layer 110.

The reconfigurable inductive conductive strip 106 provide the variable inductive reactance $L_v$ in the equivalent circuit of FIG. 3. This inductive reactance $L_v$ produces a magnetic field $H_L$ in a corresponding control plane (hereafter "$H_L$-plane"). The reconfigurable inductive strip 106 has a fixed length $l_n$ in the X direction and a variable width $w_{vl}$, in the Y direction. As will be discussed next, the reconfigurable inductive strip 106 can be reconfigured to vary the width $w_{vl}$ so as to correspondingly vary the inductive reactance $L_v$,. However, to provide the selected unit wide phase shift in the beam 104 of FIG. 1, the length In and the width $w_{vl}$ must be such that only phase change occurs in the beam 104 but not amplitude change. Thus, the length $l_n$ is preferably about 20 mm and the width $w_{vl}$ can be preferably varied around about 2.3 mm for a unit cell of 20 mm per side to provide a binary unit wide phase shift of 22.5° at 5 GHz in the beam 104 of FIG. 1 in the $E_b$-plane or the $H_b$-plane with phase change and not amplitude change of the beam 104.

Referring back to FIG. 4, the reconfigurable inductive strip 106 comprises two lower conductive strips 111, two upper conductive strips 112, and two actuator assemblies 114. The lower and upper conductive strips 111 and 112 all extend in the X direction. Each lower conductive strip 111 is fixedly coupled to the dielectric layer 110. Each upper conductive strip 112 is electrically connected to and slidably moveable on a corresponding lower strip 111. Furthermore, each upper conductive strip 112 is fixedly coupled to a corresponding actuator assembly 114. Each actuator assembly 114 is controlled by the control circuit 103 of FIG. 1 to cause the corresponding upper conductive strip 112 to slidably move on the corresponding lower conductive strip 111.

Figure 5:
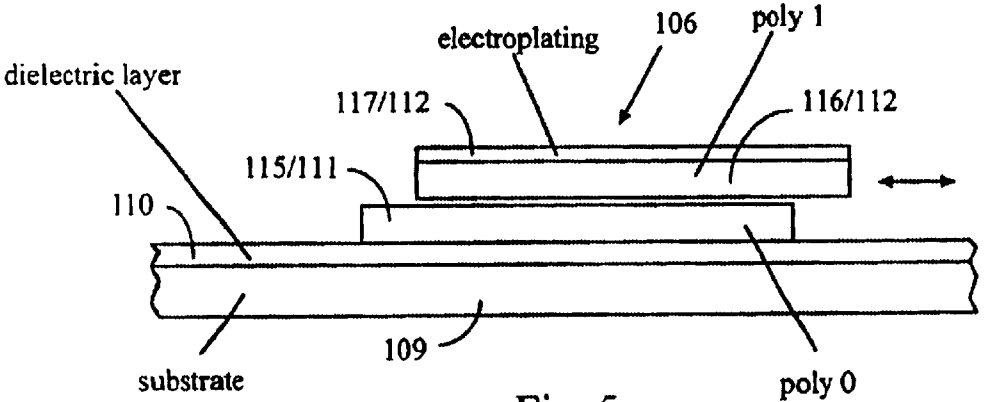
FIG. 5 shows the configuration of a reconfigurable conductive strip of the unit cell of FIG. 4.

As shown in FIG. 5, each lower conductive strip 111 comprises a semiconductor strip 115 formed on the dielectric layer 110. Each upper conductive strip 112 comprises a semiconductor strip 116 and a metal plating 117 formed on the semiconductor strip 116. The semiconductor strip 116 is electrically connected to and slidably moveable on the semiconductor strip 115. To do so, the semiconductor strip 116 comprises contact rails (not shown) like the contact rails 132 of the guide arm 129 of FIG. 6. This minimizes friction and stiction. These rails may be continuous or may comprise a row of protrusions or bumps. The metal plating 117 is used to reduce the resistivity of the upper conductive strip 112 caused by the semiconductor strip 116 so as to avoid losses at millimeter and/or sub-millimeter wavelength frequencies of the beam 104 of FIG. 1.

Referring again to FIG. 6, each actuator assembly 114 comprises actuator sub-assemblies 118 and an insulating attachment bridge 119. One of the actuator sub-assemblies 118 is configured for forward movement and the other is configured for backward movement. Each actuator sub-assembly 118 comprises a conductive support frame 120 that is fixedly coupled to the support frame 120 of the other actuator sub-assembly 118 with the insulating attachment bridge 119. The insulating attachment bridge 119 fixedly couples, but electrically isolates, the support frames 120 of the actuator sub-assemblies 118.

Each actuator sub-assembly 118 also comprises an array of SDAs (scratch-drive actuators) 121 and conductive flexible attachment arms 122. Each SDA 121 is fixedly coupled and electrically connected to the support frame 120 of the actuator sub-assembly 118 by corresponding attachment arms 122.

Figure 7:
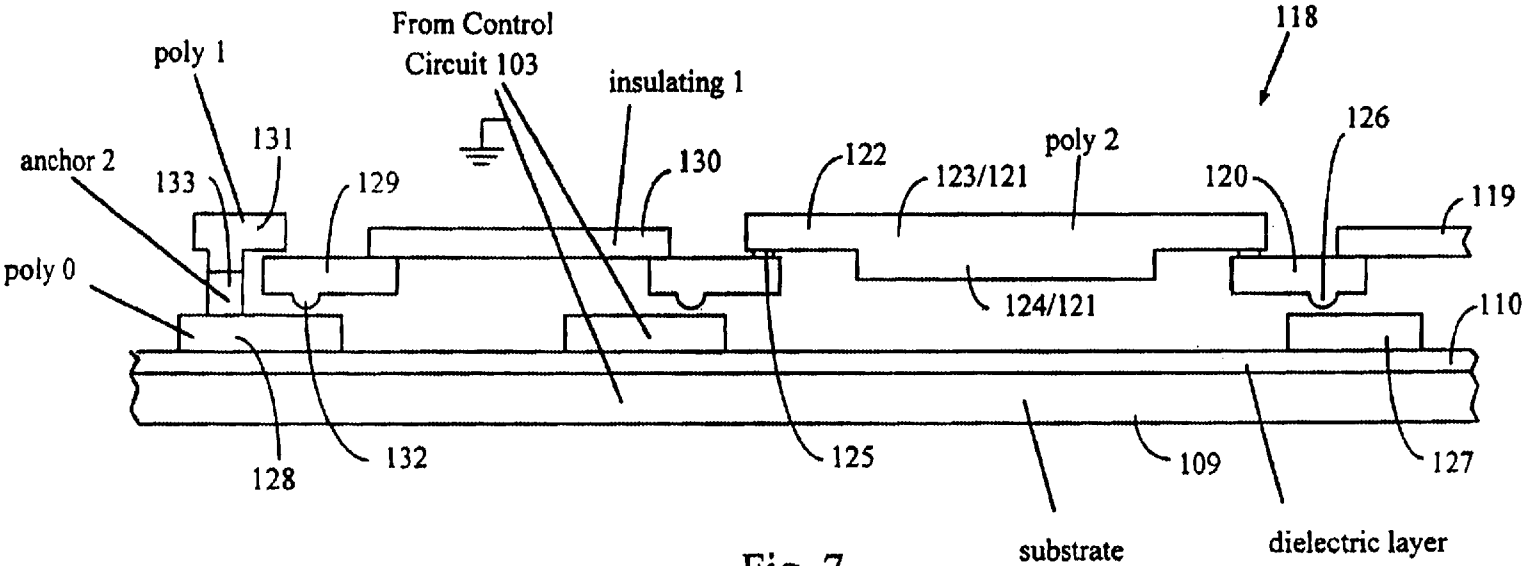
Figure 8:
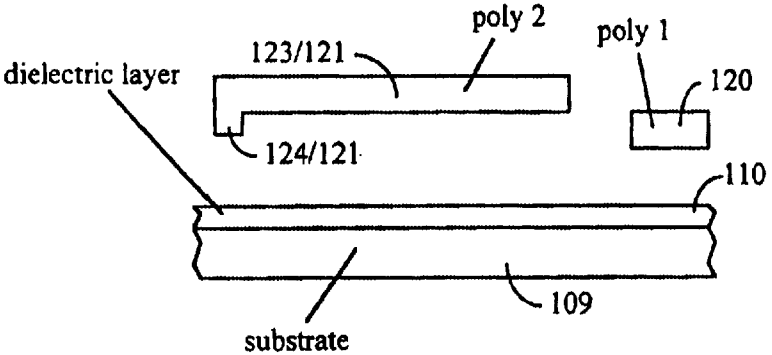

As shown in FIGS. 7 and 8, each SDA 121 comprises a corresponding plate 123 and a corresponding bushing 124. The plate 123 is fixedly coupled and electrically connected to corresponding attachment arms 122 and may be integrally formed with these attachment arms 122. The attachment arms 122 are themselves fixedly coupled and electrically connected to the support frame 120 of the corresponding actuator sub-assembly 118 by vias 125 of the actuator sub-assembly 118.

Referring back to FIG. 6, the SDAs 121 of each actuator sub-assembly 118 are aligned for forward or backward movement depending on whether the actuator sub-assembly 118 is to be used for forward or backward movement. The SDAs 121 are of the type described in T. Akiyamna and K. Shono, "Controlled Stepwise Motion in Polysilicon Microstructures", J. of MEMS, Vol. 2, No. 3, pp. 106, September 1993, and T. Akiyama and H. Fujita, "A Quantative Analysis of Scratch Drive Actuator Using Buckling Motion", IEEE Micro Electro Mechanical Systems, pp. 310–315, 1995. These articles are hereby incorporated by reference.

Referring again to FIGS. 7 and 8, each actuator sub-assembly 118 also comprises conductive contact rails 126 and conductive bias lines 127. The contact rails 126 are fixedly coupled to and patterned on the lower surface of the support frame 120 of the actuator sub-assembly 118 and, in fact, may be integrally formed with the support frame 120. The contact rails 126 are also electrically connected to the support frame 120. The bias lines 127 are fixedly coupled to and patterned on the dielectric layer 110. The contact rails 126 moveably slide on and electrically contact the bias lines 127.

Figure 6:
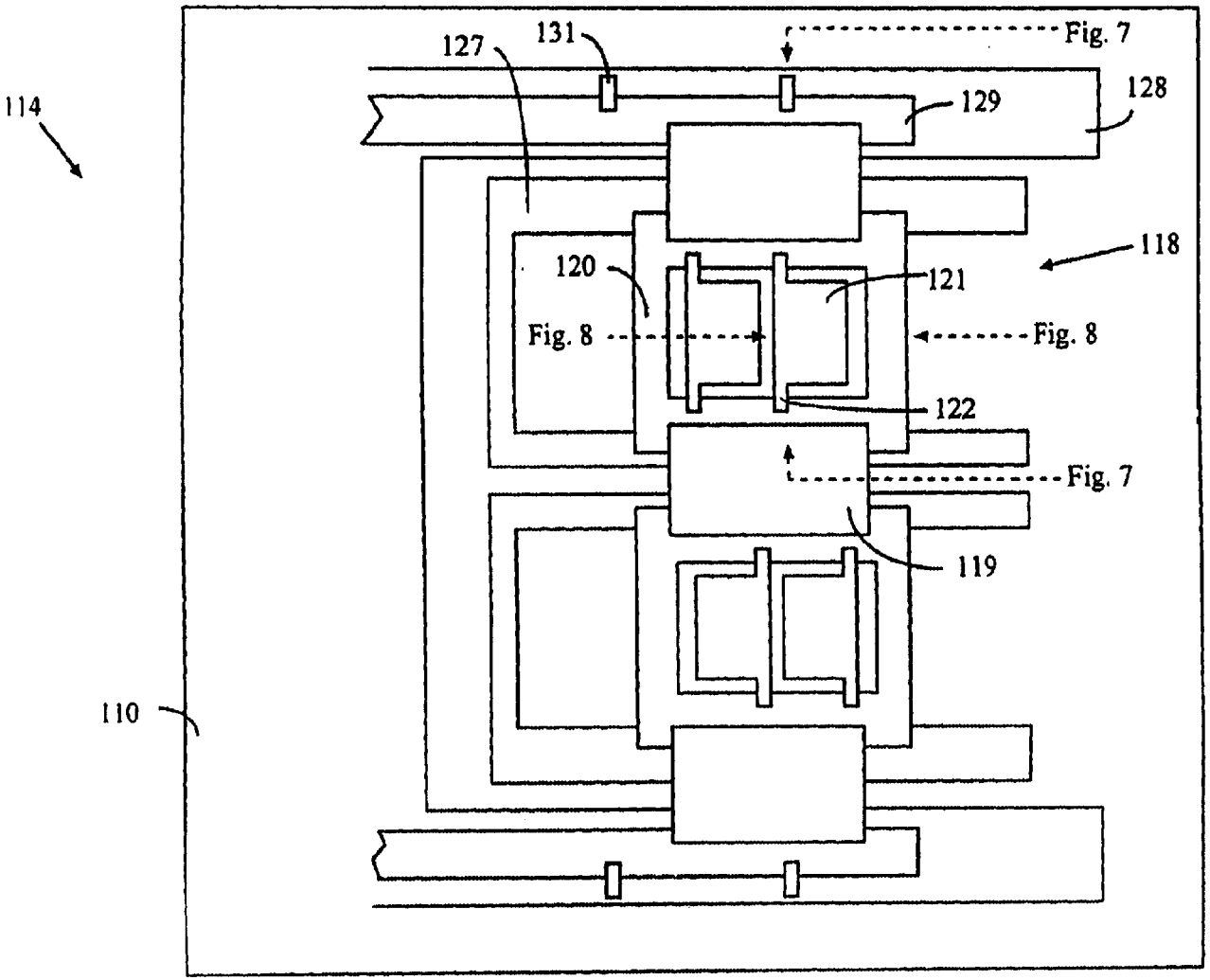
FIGS. 6 to 8 show the configuration of an actuator assembly of the unit cell of FIG. 4.

Turning now to FIGS. 6 to 8, the conductive plates 123 of the SDAs 121 of each actuator sub-assembly 118 are electrically connected to the bias lines 127 of the actuator sub-assembly 118 via the contact rails 126, support frame 120, and attachment arms 122 of the actuator sub-assembly 118. Thus, when a periodic square wave bias signal is applied to the bias lines 127 by the control circuit 103 of FIG. 1, this signal is provided to the plates 123. Since the semiconductor substrate 109 is grounded, this causes the plates 123 to be pulled down toward the dielectric layer 110 each time the signal reaches a high voltage. The plates 123 are pulled down because of the flexure in the flexible conductive attachment arms 122. Each time this occurs, the bushings 124 of the SDAs 121 reach out and contact the dielectric layer 110. Then, each time the signal goes to a low voltage, the plates 123 return to their original positions and the bushings 124 pull the entire actuator assembly 114 forward or backward a step depending on whether the actuator sub-assembly 118 is configured for forward or backward movement. In this way, the entire actuator assembly 114 moves forward or backward in a stepwise fashion.

Referring back to FIG. 6, each actuator assembly 114 also comprises lower guide arms 128, upper guide arms 129, and insulating attachment bridges 130, and guiding overhangs 131. As shown in FIG. 7, each lower guide arm is fixedly coupled to the dielectric layer 110 and, as shown in FIG. 4, may be integrally formed with a corresponding lower conductive strip 111 of the reconfigurable inductive strip 106. Each upper guide arm 129 slidably moves on a corresponding lower guide arm 128. To do so, each upper guide arm 129 comprises a contact rail 132 to minimize friction and stiction. Each rail 145 may be continuous or may comprise a row of protrusions or bumps. Each upper guide arm 129 is fixedly attached to the support frame 120 of a corresponding actuator sub-assembly 118 by a corresponding insulating attachment bridge 130.

As shown in FIG. 4, each upper guide arm 129 is also fixedly coupled to a corresponding upper conductive strip 112 of the reconfigurable inductive strip 106 and may be integrally formed with the semiconductor strip 116 of this upper conductive strip 112. As a result, each actuator assembly 114 is fixedly coupled to the corresponding upper conductive strip 112 by the corresponding upper guide arms 129 and the insulating attachment bridges 130.

Referring back to FIG. 6, each actuator assembly 114 further comprises guiding overhangs 131. As shown in FIG. 7, each guiding overhang 131 is fixedly coupled to a corresponding lower guide arm 128 by an anchor 133 of the actuator assembly 114. This enables the guiding overhang 131 to extend up from the corresponding guide arm 128 along the outer surface and over the upper surface of the corresponding upper guide arm 129. Referring again to FIG. 6, the guiding overhangs 131 collectively guide the entire actuator assembly 114 as it moves forward or backward.

Referring now to FIG. 4, each upper conductive strip 112 can therefore be slidably moved on the corresponding lower conductive strip 111 by appropriately controlling the corresponding actuator assembly 114. Specifically, when the control circuit 103 of FIG. 1 applies a forward movement bias signal between the bias lines 127 of the actuator sub-assembly 118 used for forward movement and the semiconductor substrate 109 of FIG. 6, the entire actuator assembly 114 moves laterally forward to push the upper conductive strip 112 forward. Similarly, when the control circuit 103 applies a backward movement bias voltage between the bias lines 127 of the actuator sub-assembly 118 used for backward movement and the semiconductor substrate 109, the entire actuator assembly 114 moves backward so as to pull the upper conductive strip 112 backward.

The control circuit 103 of FIG. 1 can therefore controllably cause both upper conductive strips 112 to move simultaneously laterally forward or backward. This correspondingly increases or decreases the width $w_{v1}$ of the reconfigurable inductive strip 106 so as to correspondingly increase or decrease the inductive reactance $L_v$ of FIG. 3 provided by the reconfigurable inductive strip 106. In this way, the inductive reactance $L_v$ of the reconfigurable inductive strip 106 can be controllably varied.

In alternative embodiment, each actuator assembly 114 could comprise an array of side-drive actuators, such as those described in L. Fan, Y. C. Tai, and R Muller, "IC Processed Electrostatic Micromotors", Sensors and Actuators, Vol. 20, pp. 41–47, November 1989. Or, each actuator assembly 114 could comprise an array of comb-drive actuators, such as those described in W. tang, T. Nguyen, and R. Howe, "Laterally Driven Polysilicon Resonant Microstructures", Sensors and Actuators, Vol. 20, pp. 25, November 1989. Both of these articles are hereby incorporated by reference. Additionally, thermal actuators, piezoelectric actuators, and electromagnetic actuators could also be used.

Referring back to FIG. 4, the reconfigurable conductive strips 107 form the variable capacitive reactance $C_v$ in the equivalent circuit of FIG. 3. This capacitive reactance $C_v$ produces an electric field $E_C$ in a corresponding control plane (hereafter "$E_C$-plane"). Each reconfigurable capacitive strip 107 has a fixed length $l_{f2}$ in the Y direction and a variable width $w_{v2}$ in the X direction. The capacitive reactance $C_v$ is related to a variable gap $g_v$ between the reconfigurable conductive strips 107. As will be discussed next, each reconfigurable capacitive strip 107 can be reconfigured to vary the width $w_{v2}$ so as to correspondingly vary the gap $g_v$ and thereby correspondingly vary the capacitive reactance $C_v$. Here as well, to provide the selected phase shift in the beam 104 of FIG. 1, the length $l_n$ and the width $w_{v1}$ must be such that only phase change occurs in the beam 104 but not amplitude change. The length $l_{f2}$ is preferably about 20 mm. The width $w_{v2}$ can be preferably varied between about 1 mm for a unit cell size of 20 mm per side to provide a binary unit wide phase shift of 22.5° at 5 GHz in the beam 104 of FIG. 1 in the $E_b$-plane or the $H_b$-plane with phase change and not amplitude change of the beam 104.

Referring back to FIG. 4, each reconfigurable capacitive conductive strip 107 is configured similar to the reconfigurable inductive strip 106 and comprises two lower conductive strips 134, two upper conductive strips 135, and two actuator assemblies 114. The lower and upper conductive strips 134 and 135 all extend in the Y direction.

Each lower conductive strip 134 is fixedly coupled to the dielectric layer 110. Furthermore, each lower conductive strip 134 is configured like a lower conductive strip 111 of the reconfigurable inductive strip 106 of FIG. 5 in that it comprises a semiconductor strip formed on the dielectric layer 110.

Each upper conductive strip 135 is electrically connected to and slidably moveable on a corresponding lower conductive strip 134. Each upper conductive strip 135 is configured like an upper conductive strip 112 of the reconfigurable inductive strip 106 of FIG. 5. Specifically, each upper conductive strip 135 comprises a semiconductor strip and a metal plating formed on the semiconductor strip. The semiconductor strip of the upper conductive strip 135 is electrically connected to and slidably moveable on the semiconductor strip of the corresponding lower conductive strip 134. As with the reconfigurable inductive strip 106, the metal plating is used to reduce the resistivity of the upper conductive strip 134 caused by the semiconductor strip so as to avoid losses at millimeter and/or sub-millimeter wavelength frequencies of the beam 104 of FIG. 1.

Each upper conductive strip 135 is fixedly coupled to a corresponding actuator assembly 114. This is done in the same manner that each upper conductive strip 112 of the reconfigurable inductive strip 106 is fixedly coupled to a corresponding actuator assembly 114. Each actuator assembly 114 is controlled by the control circuit 103 of FIG. 1 to cause the corresponding upper conductive strip 135 to slidably move on the corresponding lower conductive strip 134. This is done in the same way that each upper conductive strip 112 of the reconfigurable inductive strip 106 slidably moves on the corresponding lower conductive strip 111.

The control circuit 103 can therefore controllably cause the upper conductive strips 135 of one or both reconfigurable conductive strips 107 to move simultaneously laterally forward or backward. This correspondingly increases or decreases the width $w_{v2}$ of each reconfigurable capacitive strips 106 whose upper conductive strips 135 are moved. As a result, the gap $g_v$ between the reconfigurable conductive strips 107 is correspondingly increased or decreased so that the capacitive reactance $C_v$ of FIG. 3 provided by the reconfigurable conductive strips 107 is also correspondingly increased or decreased. In this way, the capacitive reactance $C_v$ can be controllably varied.

As shown in FIG. 4, the opposing internal ends of the lower conductive strips 134 and the opposing internal ends of the upper conductive strips 135 of each reconfigurable capacitive conductive strip 107 are spaced apart to provide a small gap 136 in each reconfigurable capacitive conductive strip 107. The external ends of corresponding upper and lower conductive strips 111 and 112 of the reconfigurable inductive strip 106 extend into the gap 136 of each reconfigurable capacitive conductive strip 107. This increases the length of the reconfigurable inductive strip 106 and therefore the inductive reactance $L_v$ of FIG. 3 provided by the reconfigurable inductive strip 106.

Each unit cell 105 also comprises small interconnects 137. The lower conductive strips 134 of each reconfigurable capacitive strips 106 and a corresponding lower conductive strip 111 of the reconfigurable inductive strip 106 are fixedly coupled together and electrically connected together by a corresponding small interconnect 137. Specifically, each small interconnect 137 extends across a corresponding gap 136 at the outer edge of the unit cell 105 and fixedly couples and electrically connects the opposing internal ends of the corresponding lower conductive strips 134 and the external end of the corresponding lower conductive strip I1.

In an alternative embodiment for each unit cell 105, there could be no physical coupling between the lower conductive strips 134 of each reconfigurable capacitive conductive strip 107 and the corresponding lower conductive strip 111 of the reconfigurable inductive conductive strip 106. However, for the propagating waves of the beam 104 of FIG. 1, an electrical connection still exists so that the equivalent circuit would still be that shown in FIG. 3.

Still referring to FIG. 4, the see-saw switch 108 provides the switching function S in the equivalent circuit of FIG. 3 to electrically connect and disconnect the inductive reactance $L_v$. The see-saw switch 108 is electrically connected in series with the lower conductive strips 111 of the reconfigurable inductive strip 106. The reactance of the unit cell 105 can be made primarily inductive by causing the see-saw switch 108 to electrically connect the lower conductive strips 111 of the reconfigurable inductive strip 106 so as to close the switching function S. The reconfigurable inductive strip 106 is therefore electrically connected between the reconfigurable conductive strips 107 and the inductive reactance $L_v$ of FIG. 3 provided by the reconfigurable inductive strip 106 dominates the overall reactance of the unit cell 105. Conversely, the overall reactance of the unit cell 105 can be made primarily capacitive by causing the see-saw switch 108 to electrically disconnect the lower conductive strips 111 so as to open the switching function S. As a result, the reconfigurable inductive strip 106 is electrically disconnected between the reconfigurable conductive strips 107 and the capacitive reactance $C_v$ of FIG. 3 provided by the reconfigurable conductive strips 107 dominates the overall reactance of the unit cell 105.

Figure 9:
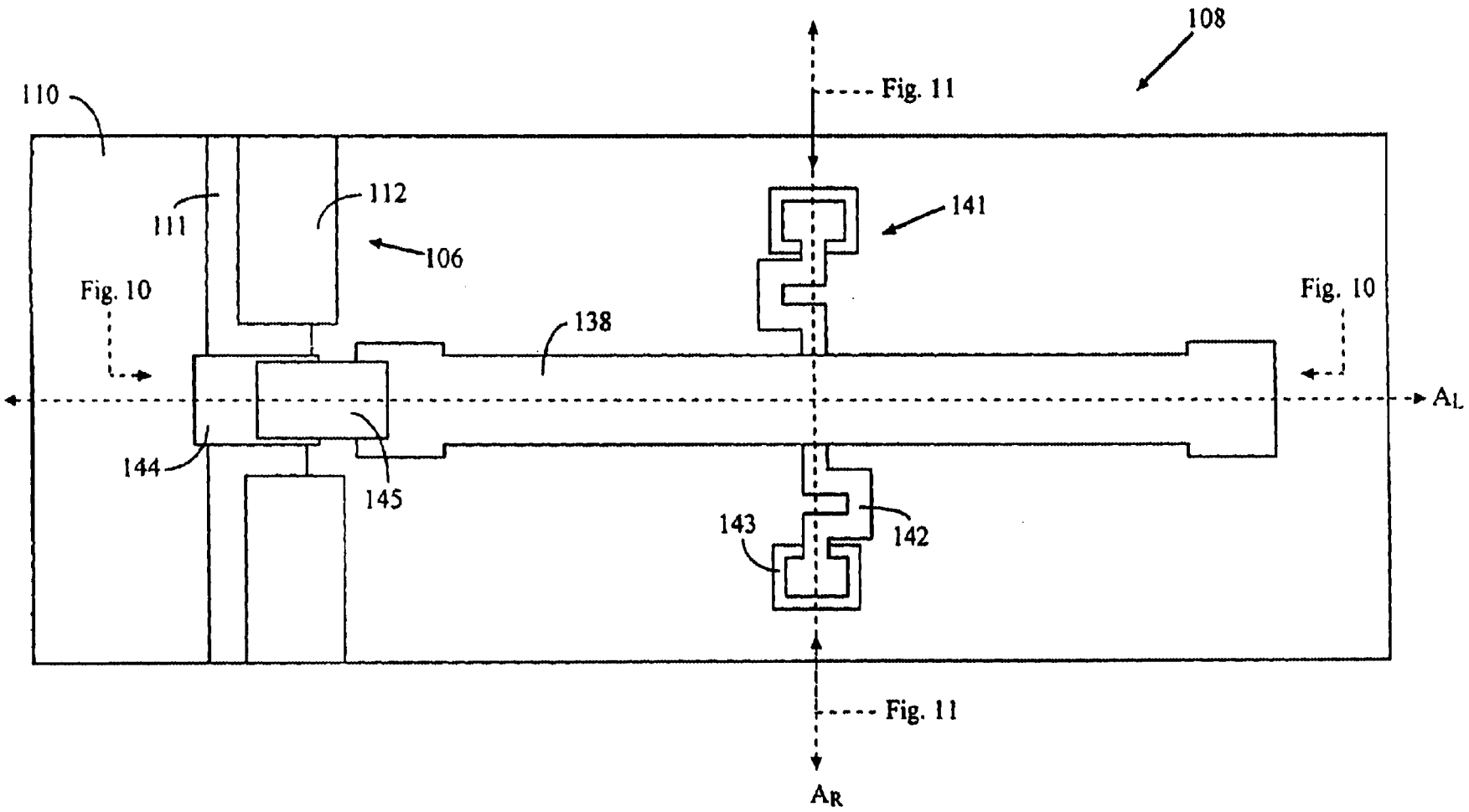
FIGS. 9 to 11 show the configuration of a MEMS see-saw switch of the unit cell of FIG. 4.
Figure 11:
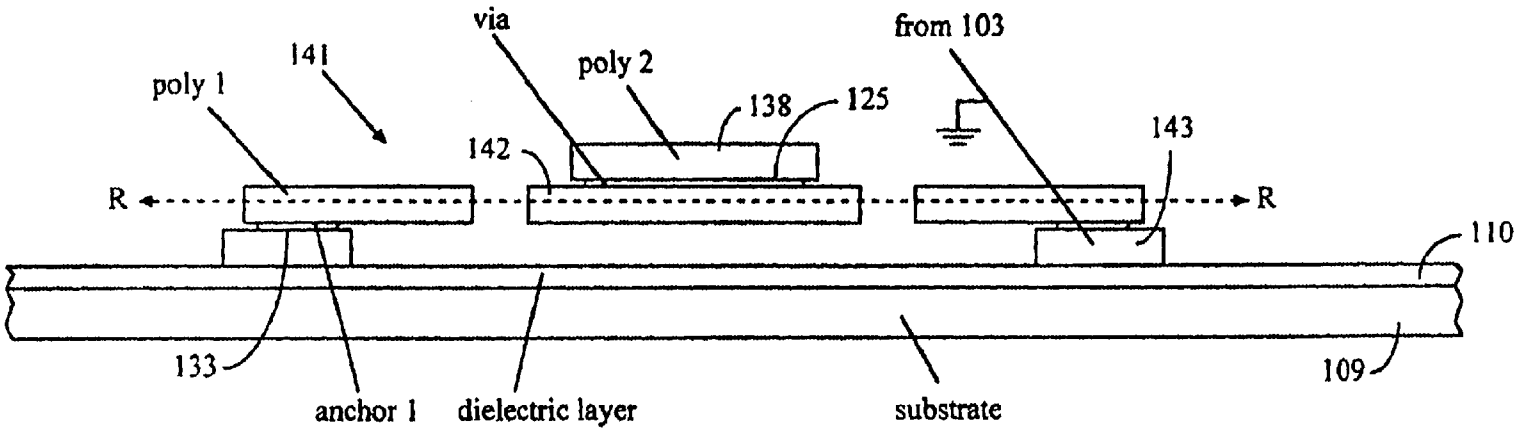
Figure 10:
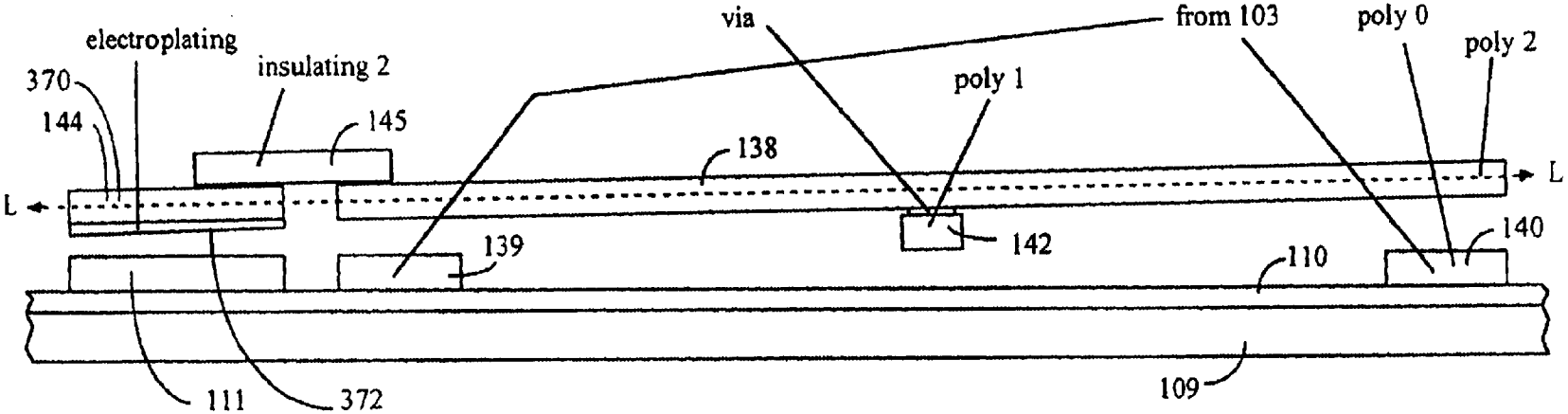

As shown in FIGS. 9 to 11, the see-saw switch 108 comprises an electrical contact 144, an insulating attachment arm 145, a pivot arm (or bar) 138, electrodes 139 and 140, and a spring hinge 141. The pivot arm 138 extends between the support bases 143 along a longitudinal axis $A_L$ that is transverse (i.e., perpendicular) to a rotation axis $A_R$ at the center of the pivot arm 138. One end of the pivot arm 138 is fixedly coupled to the insulating attachment arm 145. The insulating attachment arm 145 fixedly couples and electrically isolates the electrical contact 144 from the pivot arm 138. The electrodes 139 and 140 are fixedly coupled to the dielectric layer 110 and are located underneath opposite ends of the pivot arm 138. Thus, there is a corresponding end of the pivot arm 138 for each electrode 139 and 140. The spring hinge 141 pivotably couples the center of the pivot arm 138 to the dielectric layer 110 so that both ends of the pivot arm 138 can pivot about the rotation axis $A_R$.

The electrical contact 144 comprises a semiconductor strip 370 and a metal strip 372. The metal strip 372 is formed on the underside of the semiconductor strip 370. The semiconductor strip 370 is also fixedly coupled to the insulating attachment arm 145.

The spring hinge 141 comprises spring arms 142 and two support bases 143. The spring arms 142 extend out from the center of the pivot arm 138 in opposite directions along the rotation axis $A_R$. Each spring arm 142 has one end fixedly coupled to the center of the pivot arm 138. These ends of the spring arms 142 may be integrally formed and joined together. The other end of each spring arm 142 is fixedly coupled to a corresponding support base 143 with an anchor 133. The spring arms 142 suspend the pivot arm 138 over the dielectric layer 110 and the electrodes 139 and 140. Moreover, the spring arms 142 are patterned (i.e., configured) to provide the spring hinge 141 with the same spring constant for both clockwise and counterclockwise pivoting by the ends of the pivot arm 138. As a result, the ends of the pivot arm 138 can pivot about the rotation axis $A_R$. Furthermore, the support bases 143, the spring arms 142, and the pivot arm 138 are all conductive.

In order to close the see-saw switch 108, a voltage is applied across at least one of the support bases 143 and the electrode 139. Since the pivot blocks 142, the hinge pin 140, and the pivot arm 138 are all conductive, this voltage appears between the electrode 139 and the corresponding end of the pivot arm 140. The resulting electrostatic force overcomes the spring force of the spring hinge 141 due to the spring constant and causes the corresponding end to pivot via the pivot hinge 141 about the rotation axis $A_R$. The corresponding end is therefore pulled down toward the electrode 139 until the electrical contact 144 is laid down on and contacts the lower conductive strips 111 of the reconfigurable inductive strip 106. As a result, the lower conductive strips 111 are electrically connected. Conversely, a voltage is applied across at least one of the support bases 143 and the electrode 140 to open the see-saw switch 108. This voltage appears between the electrode 140 and the corresponding end of the pivot arm 138. The resulting electrostatic force overcomes the spring force of the spring hinge 141 and causes the corresponding end to pivot via the pivot hinge 141 about the rotation axis $A_R$. The corresponding end is pulled down toward the electrode 140 until the electrical contact 144 is lifted up from and no longer contacts the lower conductive strips 111. As a result, the lower conductive strips 111 are no longer electrically connected.

The control circuit 103 of FIG. 1 is electrically connected to at least one of the pivot blocks 142 and to both of the electrodes 139 and 140 of each see-saw switch 108. Thus, the application of the voltages for opening and closing each see-saw switch 108 is done under the control of the control circuit 103. In this way, the see-saw switch 108 provides the switching function S of FIG. 3.

In an alternative configuration, other types of MEMS switches could be used instead o the MEMS see-saw switch 108. For example, a MEMS docking switch or a MEMS Derrick switch of the type described in copending PCT Patent Applications Ser. Nos. PCT/US00/16021 and PCT/US00/16023, having respective attorney docket nos. FP-68000/JAS/SMK and FP-68677/JAS/SMK, with rrespective titles MEMS TRANSMISSION AND CIRCUIT COMPONENTS and MEMS OPTICAL COMPONENTS, and filed on Jun. 9, 2000. These patent applicatiions are incorporated by reference herein.

Referring back to FIGS. 1 and 2, each grid 101 is aligned in the beam controller 100 of FIG. 1 so that the $E_C$-plane and the $H_L$-plane of each unit cell 105 of the grid 101 are respectively perpendicular to the $E_b$-plane and the $H_b$-plane of the beam 104. As mentioned earlier, each unit cell 105 can be controllably reconfigured by the control circuit 103 of FIG. 1 to have a selected overall reactance that is primarily inductive or primarily capacitive for producing a corresponding selected unit wide phase shift in the beam 104 in its $E_b$-plane or its $H_b$-plane. This is done by selectively turning the switch switching function S of FIG. 3 provided by the switch 108 of FIG. 4 to be turned on or off and/or by selectively varying the inductive reactance $L_v$ of FIG. 3 provided by the reconfigurable inductive strip 106 of FIG. 4 and/or the capacitive reactance C, provided by the reconfigurable conductive strips 107 of FIG. 4. As a result, the electric field $E_C$ or the magnetic field $H_L$ Of each unit cell 105 can be correspondingly selected so as to cause the selected unit wide phase shift in the $E_b$-plane or the $H_b$-plane.

As just described, the unit cells 105 in each grid 101 can be separately controlled by the control circuit 103 in the manner just discussed to produce a selected continuous phase shift for the grid 101. However, there may be phase coupling between adjacent unit cells 105 if the adjacent unit cells 105 are controlled differently to produce different selected phase shifts. Thus, the unit cells 105 could be grouped in blocks as described later for the grids 154. Each block would be separately controlled by the control circuit 103 with the unit cells 105 in each block being jointly controlled in the same way to provide the same overall reactance. This has the benefit of reducing phase coupling between adjacent unit cells 105, optimizing beam resolution, and simplifying the control circuit 103 of FIG. 1.

As just mentioned, each unit cell 105 can be controllably reconfigured by the control circuit 103 of FIG. 1 by appropriately controlling switch 108 of FIG. 4 to turn on or off the switching function S of FIG. 3 provided by the switch 108. However, as those skilled in the art will recognize, if the switching function S is not desired, the switch 108 could be removed from each unit cell 105. Also, the reconfigurable inductive strip 106 could be replaced by the fixed inductive strip 148 of the unit cell 147 of FIG. 14 if a fixed inductive reactance $L_f$ is desired instead of the variable inductive reactance $L_v$. Similarly, the reconfigurable capacitive strips 107 could be replaced by the fixed capacitive strips 149 of the unit cell 147 of FIG. 14 if a fixed capacitive reactance $C_f$ is desired instead of the variable capacitive reactance $C_v$.

Referring back to FIG. 4, as those skilled in the art will recognize, the unit cell 105 is not drawn to scale. This is done in order to better illustrate the reconfigurability of the unit cell 105, namely the switch 108 and the inductive and capacitive conductive strips 106 and 107. More specifically, the actuator assemblies 1 14 of the inductive and capacitive conductive strips 106 and 107 would be much smaller and so would the switch 108. Furthermore, preferably, the actuator assemblies 114 of the inductive conductive strip 106 would in fact be located in the lower conductive strips 134 of the capacitive conductive strips 107. This will make the actuator assemblies 114 invisible to the propagating waves of the beam 104 of FIG. 1.

Grids 146

Figure 12:
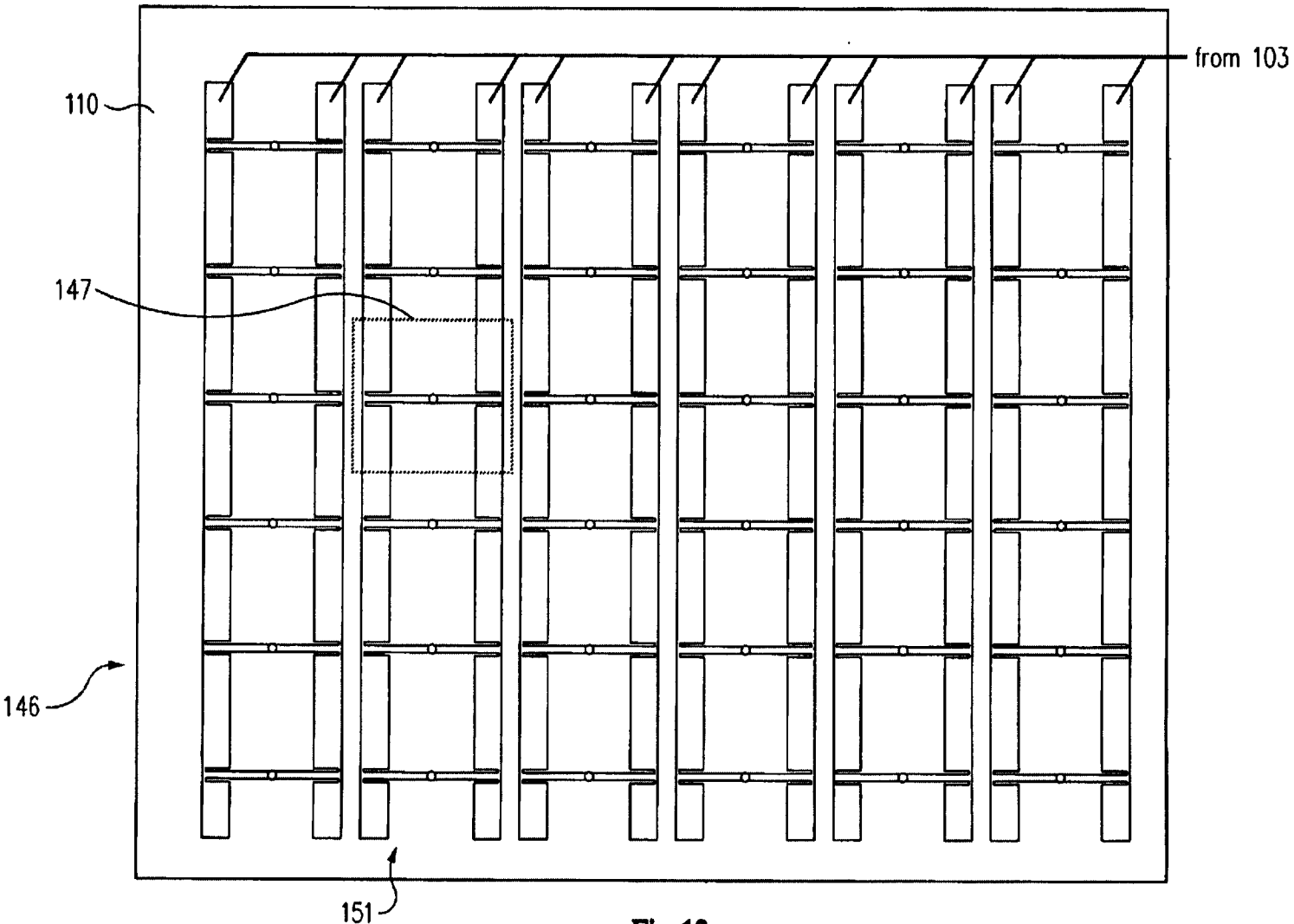
FIGS. 12 and 15 show other quasi-optical grids that can be used in the beam controller of FIG. 1.

Referring to FIG. 12, each of the grids 146 that could be used in the beam controller 100 of FIG. 1 comprises reconfigurable unit cells 147. The unit cells 147 of each grid 146 are integrally formed together in a configuration to produce bean control in the $E_b$-plane of the beam 104 of FIG. 1.

Figure 13:
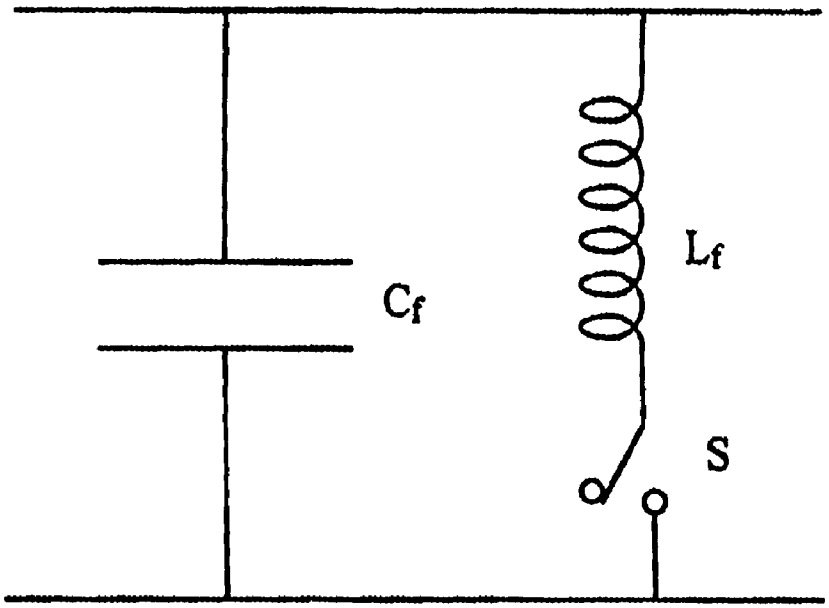
FIG. 13 shows the equivalent circuit of each quasi-optical unit cell of the grids of FIGS. 12 and 15.

Referring to FIG. 13, the equivalent circuit for each unit cell 147 is the same as that shown in FIG. 3 for each unit cell 105, except that the inductive and capacitive reactances $L_F$ and $C_F$ are fixed. Here, the overall reactance of the unit cell 105 can be varied by simply turning the switching function S on or off.

Figure 14:
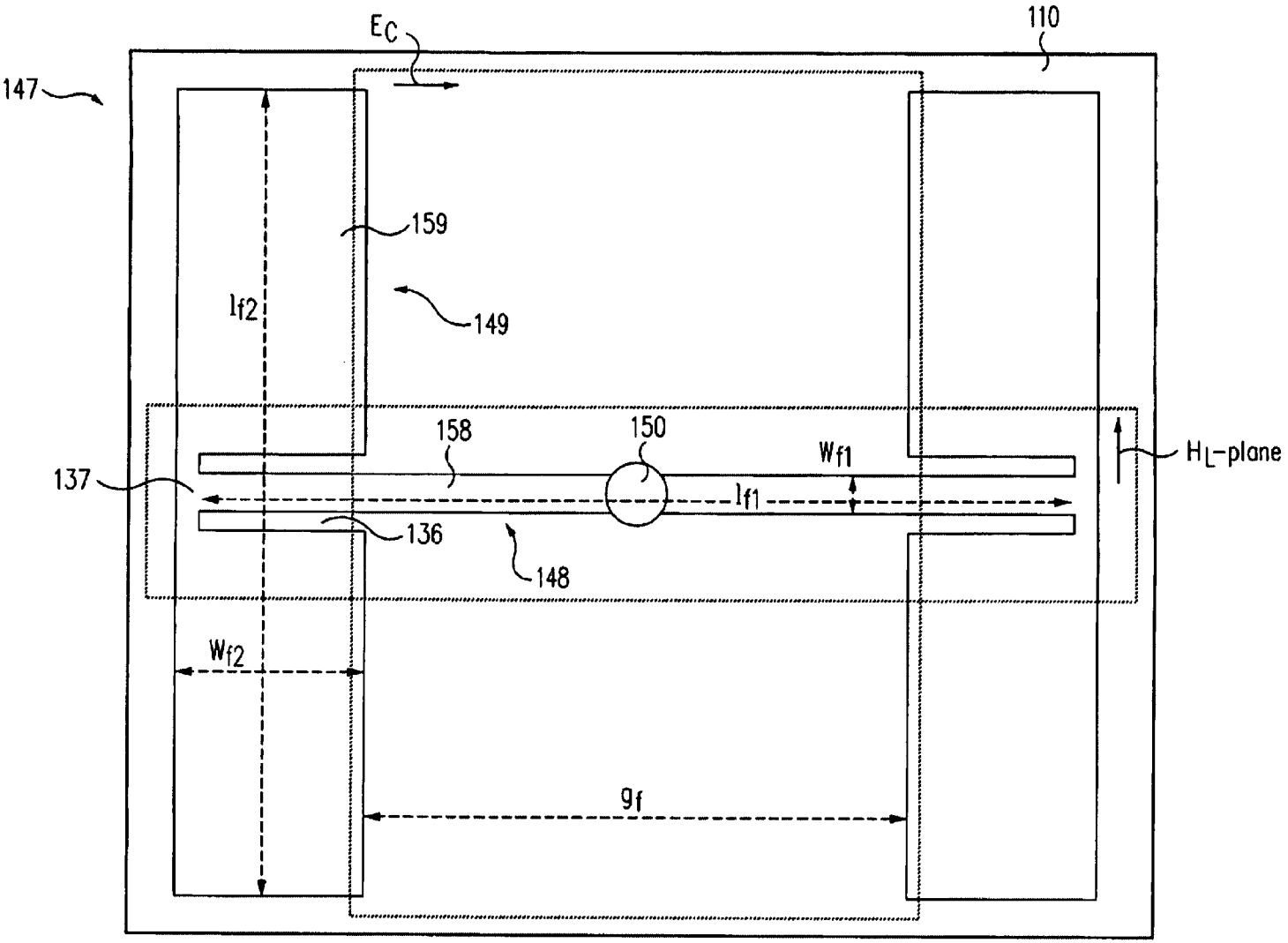
FIG. 14 shows one configuration for each unit cell of FIGS. 12 and 15 in order to implement the equivalent circuit of FIG. 13.

FIG. 14 shows one possible configuration for each unit cell 147 to provide the equivalent circuit of FIG. 13. Each unit cell 147 is configured and operates similar to the unit cell 105 of FIG. 3 described earlier. Thus, only the significant differences will be discussed next.

Each unit cell 147 comprises a fixed inductive strip 148 instead of the reconfigurable inductive strip 106 of the unit cell 105 of FIG. 4. The fixed inductive strip 148 provides the fixed inductive reactance $L_f$ in the equivalent circuit of FIG. 13 which produces the magnetic field $H_L$ in the $H_L$-plane. Like the reconfigurable inductive strip 106, the fixed inductive strip 148 has a fixed length $l_{f1}$ in the X direction. However, unlike the reconfigurable inductive strip 106, the fixed inductive strip 148 has a fixed width $w_{f1}$ in the Y direction. The width $w_{f1}$ is preferably about 2.3 mm for unit cell size of 20 mm per side to provide a binary unit wide phase shift of 22.5° at 5 GHz in the beam 104 of FIG. 1 in the $E_b$-plane or the $H_b$-plane with phase change and not amplitude change of the beam 104.

Each fixed fixed inductive strip 148 comprises two fixed conductive strips 158 fixedly coupled to the dielectric layer 110. Similar to each upper conductive strip 112 of each reconfigurable inductive strip 106 of FIG. 5, each fixed conductive strip 158 comprises a semiconductor strip formed and a metal plating formed on the semiconductor strip. However, in this case the semiconductor strip is formed on the dielectric layer 110. As with the reconfigurable inductive strip 106, the metal plating is used to reduce the resistivity of the fixed conductive strip 158 caused by the semiconductor strip so as to avoid losses at millimeter and/or sub-millimeter wavelength frequencies of the beam 104 of FIG. 1.

Furthermore, each unit cell 147 comprises two parallel fixed capacitive strips 149 instead of the reconfigurable conductive strips 107 of the unit cell 105 of FIG. 4. The fixed fixed capacitive strips 149 provide the fixed capacitive reactance $C_f$ in the equivalent circuit of FIG. 13. Here, the fixed capacitive reactance $C_f$ is proportional to a fixed gap $g_f$ between the fixed capacitive strips 149 and produces the magnetic field $H_L$ in the $H_L$-plane. Like each reconfigurable capacitive strips 106, each fixed capacitive strip 149 has a fixed length $l_{f2}$ in the Y direction. However, unlike each reconfigurable capacitive strips 106, each fixed capacitive strip 149 has a fixed width $w_{f1}$ in the X direction. The width $w_{fl}$ is preferably about 2.3 mm to provide the binary phase shift in the beam 104 of FIG. 1 in the $E_b$-plane or the $H_b$-plane with phase change and not amplitude change of the beam 104 for a unit cell size of 20 mm per side to provide a binary unit wide phase shift of 22.5° at 5 GHz in the beam 104 of FIG. 1 in the $E_b$-plane or the $H_b$-plane with phase change and not amplitude change of the beam 104.

Each fixed conductive strip 149 comprises two fixed conductive strips 159 fixedly coupled to the dielectric layer 110. Similar to each upper conductive strip 112 of each reconfigurable inductive strip 106 of FIG. 5, each fixed conductive strip 159 comprises a semiconductor strip and a metal plating formed on the semiconductor strip. However, in this case the semiconductor strip is formed on the dielectric layer 110. As with the reconfigurable inductive strip 106, the metal plating is used to reduce the resistivity of the fixed conductive strip 158 caused by the semiconductor strip so as to avoid losses at millimeter and/or sub-millimeter wavelength frequencies of the beam 104 of FIG. 1.

Instead of the MEMS see-saw switch 108 of the unit cell 105 of FIG. 4, each unit cell 147 comprises PIN diode switch 150 that is electrically connected in series with the fixed conductive strips 158 of the fixed fixed inductive strip 148. This PIN diode switch 150 may be of the type described in Stephan, K. et. al., "Quasi-optical Millimeter-Wave Hybrid and Monolithic PIN Diode Switches", *IEEE Trans. Microwave Theory Tech.*, pp. 1791 to 1798, October 1993. This article is incorporated by reference herein.

The PIN diode switch 150 provides the switching function S in the equivalent circuit of FIG. 13. Similar to the unit cell 105 of FIG. 4, the overall reactance of the unit cell 147 can be made primarily inductive by causing the PIN diode switch 147 to electrically connect the conductive strips 158 of the fixed fixed inductive strip 148 so as to close the switching function S. As a result, the inductive reactance $L_f$ of FIG. 13 provided by the fixed fixed inductive strip 148 dominates the overall reactance of the unit cell 147. Conversely, the overall reactance of the unit cell 148 can be made primarily capacitive by causing the PIN diode switch 150 to electrically disconnect the conductive strips 158 so as to open the switching function S. As a result, the capacitive reactance $C_f$ of FIG. 13 provided by the fixed capacitive strips 149 dominates the overall reactance of the unit cell 147.

The anode and the cathode of the PIN diode switch 150 are fixedly coupled and electrically connected to corresponding conductive strips 158 of the fixed inductive strip 148. The anode of the PIN diode switch 150 is electrically connected to the conductive strips 159 of a corresponding fixed capacitive strip 149 via the corresponding conductive strip 158 and a corresponding small interconnect 137. Similarly, the cathode of the PIN diode switch 150 is electrically connected to the conductive strips 159 of a corresponding fixed capacitive strip 149 via the corresponding conductive strip 158 and a corresponding small interconnect 137.

The PIN diode switch 150 is closed and opened by respectively forward and reverse biasing it. Specifically, to close the PIN diode switch 150, a forward bias DC voltage is applied across the conductive strips 159 of the corresponding fixed capacitive strip 149 electrically connected to the anode and the conductive strips 159 of the corresponding fixed capacitive strip 149 electrically connected to the cathode. This voltage then appears across the anode and the cathode of the PIN diode switch 150. Conversely, to closes the PIN diode switch 150, a reverse bias DC voltage is applied across the conductive strips 159 electrically connected to the anode and the capacitive strips 159 electrically connected to the cathode. This voltage also appears across the anode and the cathode of the PIN diode switch 150.

Each unit cell 147 can therefore be controllably reconfigured by the control circuit 103 of FIG. 1 to have a selected overall reactance that is primarily inductive or primarily capacitive for producing a corresponding binary unit wide phase shift in the beam 104 in its $E_b$-plane or its $H_b$-plane. This is done by selectively turning the switch switching function S of FIG. 13 provided by the PIN diode switch 150 of FIG. 14 to be turned on or off. As a result, the electric field $E_C$ or the magnetic field $H_L$ of each unit cell 105 can be correspondingly binarily changed so as to cause the binary unit wide phase shift in the beam 104 of FIG. 1 in its $E_b$-plane or its $H_b$-plane.

However, referring back to FIG. 12, the unit cells 147 are integrally formed together in a configuration to produce beam control in the $E_b$-plane of the beam 104. This is done by grouping the unit cells 147 in columns 151. Each column 151 is separately controlled by the control circuit 103 of FIG. 1 so that all of the unit cells 147 in the column 151 will have the same overall reactance to provide a binary column wide phase shift in the beam 104 in its $E_b$-plane.

Specifically, in each column 151, the fixed capacitive strips 149 that are electrically connected to the anodes of the PIN diode switches 150 of the unit cells 147 in the column 151 are fixedly coupled and electrically connected together and, in fact, may be all integrally formed together. Similarly, in each column 151, the fixed capacitive strips 149 that are electrically connected to the cathodes of the PIN diode switches 150 of the unit cells 147 in the column are all fixedly coupled and electrically connected together. They also may be all integrally formed together. As a result, the PIN diode switches 150 of the unit cells 147 in each column 151 are electrically connected in parallel.

For each column 151, the control circuit 103 of FIG. 1 can therefore cause all of the PIN diode switches 150 of the unit cells 147 in that column 151 to be closed or opened. This is done by applying a forward bias DC voltage or a reverse bias DC voltage across the two fixed capacitive strips 149 of just one of these unit cells 147. As a result, this voltage appears across the anodes and cathodes of all of the PIN diode switches 150 of the unit cells 147. Since all of the PIN diode switches 150 will be closed or open in response, all of these unit cells 147 will have the same overall reactance.

Referring back to FIGS. 1 and 12, each grid 146 is aligned in the beam controller 100 of FIG. 1 so that the $E_C$-plane of each unit cell 147 of the grid 146 is perpendicular to the $E_b$-plane of the beam 104. As mentioned earlier, the unit cells 147 in a column 151 will be controllably reconfigured by the control circuit 103 of FIG. 1 in the same way to have the same selected overall reactance for producing the same corresponding binary unit wide phase shift in the beam 104 in its $E_b$-plane. This is done by controlling the PIN diode switches 150 of FIG. 14 of the unit cells 147 in the column 151 to turn on or off their corresponding switching functions S of FIG. 13 so that the overall reactances of the unit cells 147 in the column 151 can all be made primarily inductive or primarily capacitive. The electric fields $E_C$ of the unit cells 147 in the column 151 are therefore all binarily changed in the same way to control the beam 104 in the same way in its $E_b$-plane. This results in a corresponding binary column wide phase shift in the $E_b$-plane.

By reconfiguring the unit cells 147 of columns 151 of a grid 146 in this way, a corresponding discrete phase shift in the $E_b$-plane is achieved with the grid 146. If multiple grids 146 are used in the beam controller 100 of FIG. 1, the total phase shift in the $E_b$-plane that occurs across the grids 146 comprises progressive discrete phase shifts.

In an alternative configuration, a MEMS $SiO_2$ membrane switch could be used instead of the PIN diode switch 150. The configuration of each unit cell 147 and each grid 146 in this embodiment would be very similar since such a membrane switch also requires forward and reverse bias DC voltages for opening and closing it. This type of membrane switch is disclosed in Chiao, J. C. et. al., "Microswitch Beam-Steering Grid", *IEEE Trans. Microwave Theory Tech.*, pp. 1791 to 1798, October 1993. This article is incorporated by reference herein.

As mentioned earlier, each unit cell 147 has the fixed inductive and capacitive strips 148 and 149 of FIG. 14. However, as those skilled in the art will recognize, each unit cell 147 could instead include the reconfigurable inductive and capacitive strips 106 and 107 of the unit cell 105 of FIG. 4. In this case, each unit cell 147 would be controllably reconfigurable by the control circuit 103 of FIG. 1 to have a selected overall reactance for producing a corresponding selected unit wide phase shift in the beam 104 in the $E_b$-plane or $H_b$-plane. But, by reconfiguring the unit cells 147 of a column 151 to have the same selected overall reactance, a corresponding selected column wide phase shift in the $E_b$-plane can therefore be achieved with the column 151. Since this may be done with each column 151 of a grid 146, a corresponding discrete phase shift in the $E_b$-plane is achieved with the grid 146. If multiple grids 146 are used in the beam controller 100 of FIG. 1, the total phase shift in the $E_b$-plane that occurs across the grids 146 comprises progressive continuous phase shifts.

Grids 152

Figure 15:
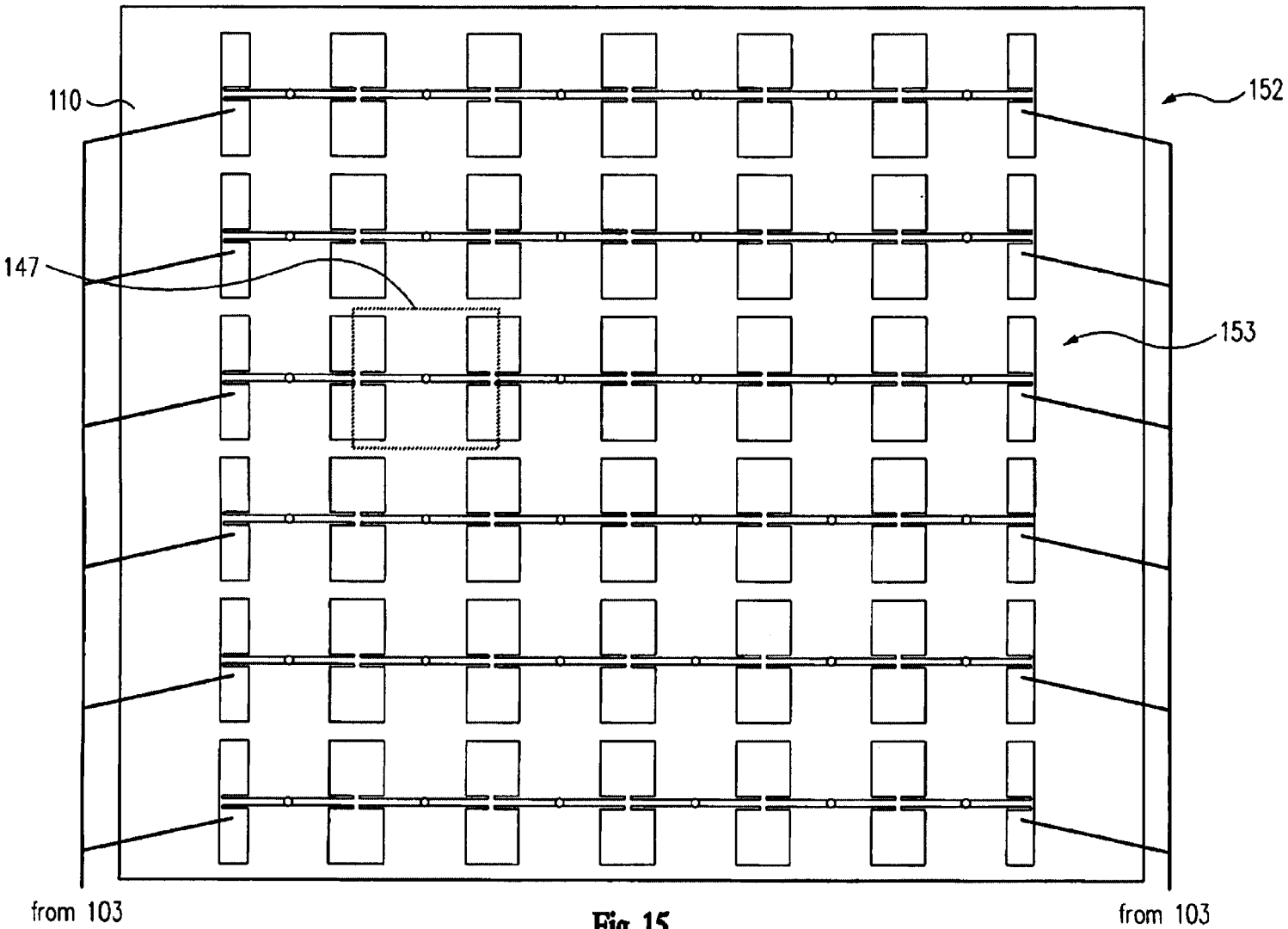

Referring to FIG. 15, each of the grids 152 that could be used in the beam controller 100 of FIG. 1 also comprises the reconfigurable unit cells 147. However, in contrast to each grid 146 of FIG. 10, the unit cells 147 are integrally formed together in a configuration on each grid 152 to produce beam control in the $H_b$-plane of the beam 104 of FIG. 1. Specifically, the unit cells are grouped in rows 153. Each row 153 is separately controlled by the control circuit 103 of FIG. 1 so that all of the unit cells 147 in the row 153 will have the same overall reactance to provide a binary row wide phase shift in the beam 104 in its $H_b$-plane.

The fixed capacitive strips 149 and the small interconnects 137 of adjacent unit cells 147 in each row 153 are fixedly coupled and electrically connected. In fact, they may be integrally formed together. As a result, the PIN diode switches 150 of the unit cells 147 in each row 153 are electrically connected in series.

For each row 153, the control circuit 103 of FIG. 1 can therefore cause all of the PIN diode switches 150 of the unit cells 147 in that row 153 to be closed or opened. This is done by applying a forward bias DC voltage or a reverse bias DC voltage across the fixed capacitive strips 149 of the last and first unit cells 147 of the row. As a result, a forward bias DC voltage or a reverse bias DC voltage appears across the anode and cathode of each PIN diode switch 150 of the unit cells of the row 153. Since all of these PIN diode switches 150 will be closed or open in response, all of the unit cells 147 in the row 153 will have the same reactance.

Referring back to FIGS. 1 and 13, each grid 152 is aligned in the beam controller 100 of FIG. 1 so that the $H_C$-plane of each unit cell 147 of the grid 152 is perpendicular to the $H_b$-plane of the beam 104. The unit cells 147 in each row 153 will be controllably reconfigured by the control circuit 103 of FIG. 1 in the same way to have the same selected overall reactance for producing the same binary unit wide phase shift in the beam 104 in the $H_b$-plane. This is done by controlling the PIN diode switches 150 of FIG. 14 of the unit cells 147 in the row 153 to turn on or off their corresponding switching functions S of FIG. 13 so that the overall reactances of the unit cells 147 in the row 153 can all be made primarily inductive or primarily capacitive. The magnetic fields $H_L$ of the unit cells 147 in the row 153 are therefore all binarily changed in the same way to control the beam 104 in the same way in its $H_b$-plane. This results in a corresponding binary row wide phase shift in the $H_b$-plane.

By reconfiguring the unit cells 147 of rows 153 of a grid 152 in this way, a corresponding discrete phase shift in the $H_b$-plane is achieved with the grid 152. If multiple grids 152 are used in the beam controller 100 of FIG. 1, the total phase shift in the $H_b$-plane that occurs across the grids 152 comprises progressive discrete phase shifts.

In an alternative embodiment for each unit cell 147 in a grid 152, there could be no physical coupling between the conductive strips 159 of each fixed capacitive strip 149 and the corresponding conductive strip 158 of the fixed inductive strip 148. However, for millimeter and sub-millimeter wavelength frequencies of the beam 104 of FIG. 1, an electrical connection still exists so that the equivalent circuit would still be that shown in FIG. 13.

As mentioned for the grid 146 of FIG. 12, each unit cell 147 in each grid 152 could include the reconfigurable inductive and capacitive strips 106 and 107 of the unit cell 105 of FIG. 4 instead of the fixed inductive and capacitive strips 148 and 149. Here, by reconfiguring the unit cells 147 of each row 153 to have the same selected overall reactance, a corresponding selected row wide phase shift in the $H_b$-plane can therefore be achieved with each grid 152. Since this may be done with each row 153 of a grid 152, a corresponding discrete phase shift in the $H_b$-plane is achieved with the grid 152. If multiple grids 152 are used in the beam controller 100 of FIG. 1, the total phase shift in the $H_b$-plane that occurs across the grids 152 comprises progressive continuous phase shifts.

Grids 154

Figure 16:
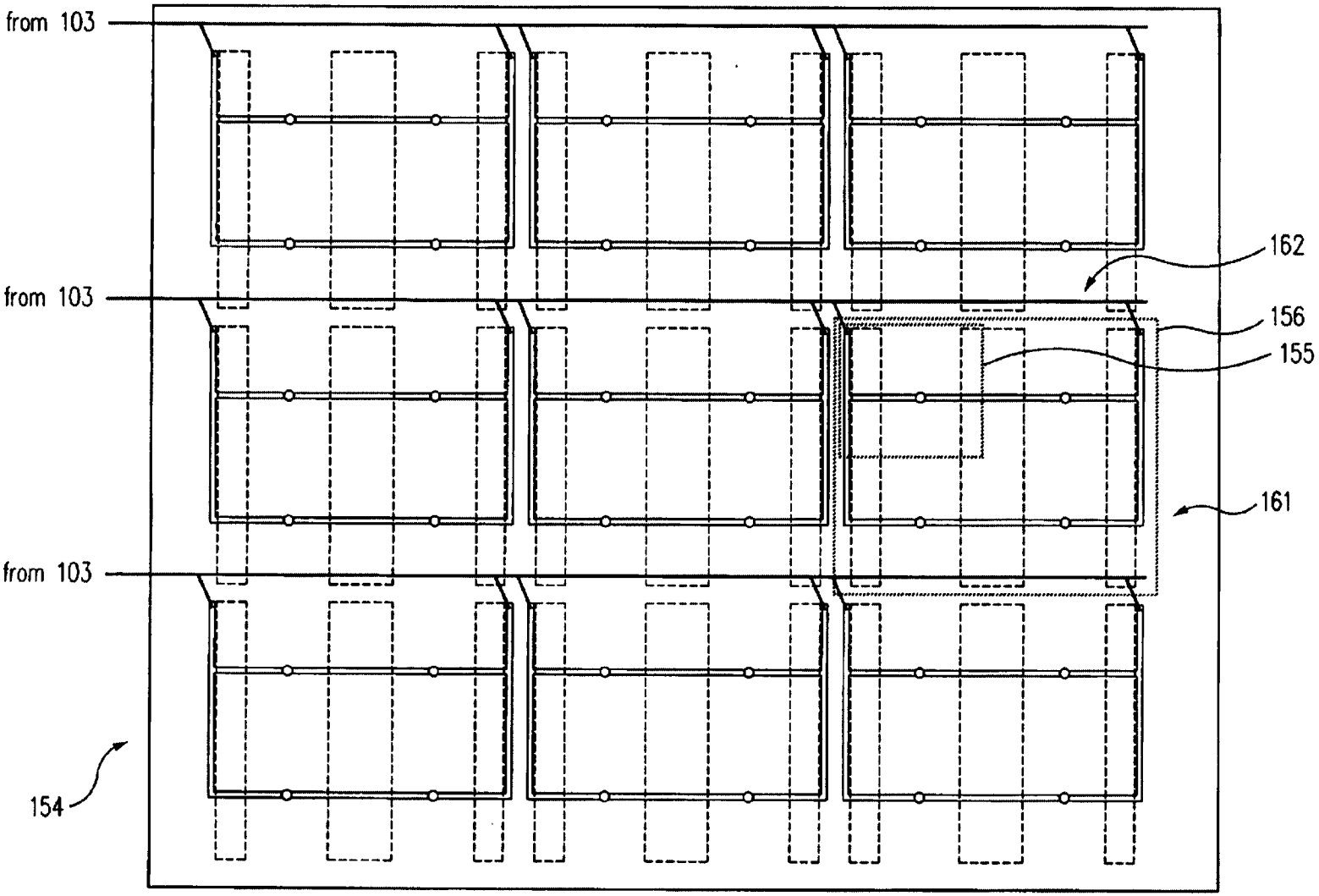
FIG. 16 shows yet another quasi-optical grid that can be used in the beam controller of FIG. 1.

Referring to FIG. 16, each of the grids 154 that could also be used in the beam controller 100 of FIG. 1 comprises reconfigurable unit cells 155. The unit cells are integrally formed together in a configuration on each grid 152 to produce beam control in the $E_b$-plane and/or the $H_b$-plane of the beam 104 of FIG. 1. In contrast to the unit cells 105 of the grid 101 of FIG. 2 and the unit cells 147 of the grid 146 of FIG. 10, the unit cells 155 are grouped into blocks 156. Each block 156 is separately controlled by the control circuit 103 of FIG. 1 so that all of the unit cells 155 in the block 155 will have the same overall reactance to provide a selected block wide phase shift in the beam 104 in its $E_b$-plane or its $H_b$-plane.

Each unit cell 155 is configured and operates similar to the unit cell 147 of FIG. 14 and implements the equivalent circuit of FIG. 13. Thus, only the significant differences will be discussed next.

Figure 17:
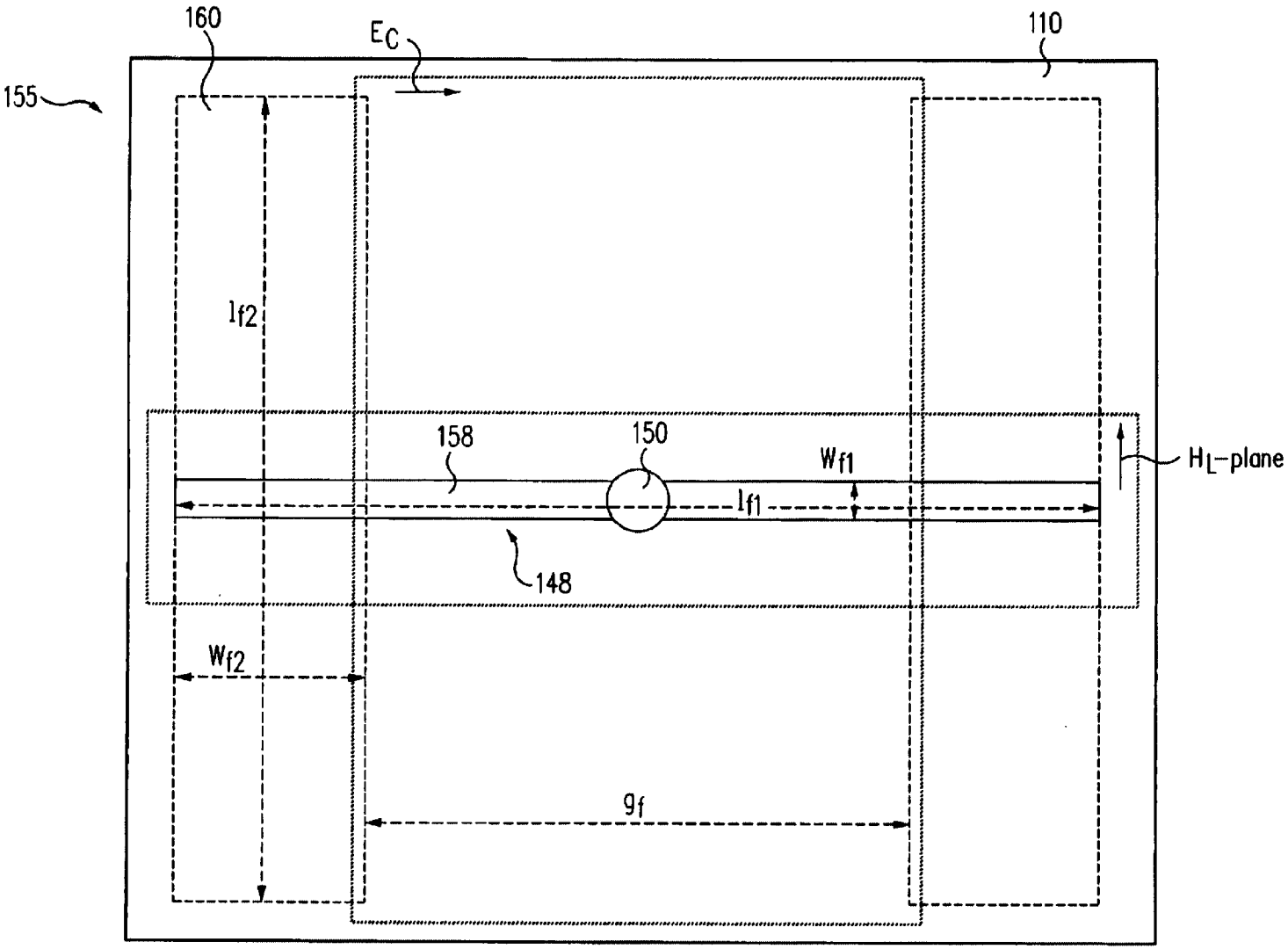
FIG. 17 shows one configuration for each unit cell of FIG. 16 in order to implement the equivalent circuit of FIG. 13.

Referring to FIG. 17, each unit cell 155 comprises a corresponding dielectric layer 110 on each of the opposite sides of the substrate 109. Like the unit cell 147 of FIG. 147 of FIG. 14, the unit cell 155 also comprises a corresponding fixed inductive strip 148 and a corresponding PIN diode switch 150 that are both formed on one dielectric layer 110. As with the unit cell 147, the fixed inductive strip 148 and a corresponding PIN diode switch 150 provide the fixed inductive reactance $L_f$ and the switching function S of the equivalent circuit of FIG. 13. However, in contrast to the unit cell 147, the unit cell 155 comprises corresponding fixed capacitive strips 160 on the other dielectric layer 110. The fixed capacitive strips 160 provide the fixed capacitive reactance $C_f$ of the equivalent circuit of FIG. 13.

Similar to each upper conductive strip 112 of each reconfigurable inductive strip 106 of FIG. 5, each fixed conductive strip 160 comprises a semiconductor strip and a metal plating formed on-the semiconductor strip. However, in this case the semiconductor strip is formed on the dielectric layer 110. As with the reconfigurable inductive strip 106, the metal plating is used to reduce the resistivity of the fixed conductive strip 160 caused by the semiconductor strip so as to avoid losses at millimeter and/or sub-millimeter wavelength frequencies of the beam 104 of FIG. 1.

Furthermore, it is important to note here that there is no physical coupling between the fixed capacitive strips 160 and the fixed inductive strip 148. However, for millimeter and sub-millimeter wavelength frequencies of the beam 104 of FIG. I, an electrical connection still exists so that the equivalent circuit would still -be that shown in FIG. 13. Therefore, the unit cell 155 would still provide a binary unit wide phase shift in the beam 104 of FIG. 1 in its $E_b$-plane or its $H_b$-plane. Since the fixed inductive and capacitive strips 148 and 160 are on opposite sides of the unit cell 155, this binary unit wide phase shift is optimized.

As mentioned earlier, the unit cells 155 are grouped in blocks 156. Each block 156 includes rows 161 and columns 162.

In each block 156, the conductive strips 158 of the fixed inductive strips 148 of adjacent unit cells 155 in each row 161 are fixedly coupled and electrically connected. In fact, they may be integrally formed together. As a result, the PIN diode switches 150 of the unit cells 155 in each row 161 are electrically connected in series.

In addition, each block 156 comprises bias lines 163 formed on the dielectric layer 110 on which the fixed inductive strips 148 are formed. One bias line 163 fixedly couples and electrically connects together the conductive strips 158 of the fixed inductive strips 148 of unit cells 155 in the first column 162 that are electrically connected to the anodes of the PIN diode switches 150 of these unit cells 155. This bias line 163 may be integrally formed together with these conductive strips 158. The other bias line 163 fixedly couples and electrically connects together the conductive strips 158 of the fixed inductive strips 148 of unit cells 155 in the last column 162 that are electrically connected to the cathodes of the PIN diode switches 150 of these unit cells 155. This bias line 163 may be integrally formed together with these conductive strips 158.

Furthermore, in each column 162 of each block 156, the fixed capacitive strips 149 of the unit cells 155 in that column 162 that are electrically connected to the anodes of the PIN diode switches 150 of these unit cells 155 are fixedly coupled and electrically connected together and, in fact, may be all integrally formed together. Similarly, in each column 162 of each block 156, the fixed capacitive strips 149 of the unit cells 155 in that column 162 that are electrically connected to the cathodes of the PIN diode switches 150 of these unit cells 155 are fixedly coupled and electrically connected together. They also may be all integrally formed together.

However, in an alternative configuration for each grid 154, the fixed capacitive strips 149 of each unit cell 155 in each block 156 would not be physically coupled to the fixed capacitive strips 149 of any other unit cell 155 in the block 156. This is due to the fact that the equivalent circuit of FIG. 13 would still be the same for each unit cell 155.

For each block 156, the control circuit 103 of FIG. 1 can therefore cause all of the PIN diode switches 150 of the unit cells 155 in that block 156 to be closed or opened. This is done by applying a forward bias DC voltage or a reverse bias DC voltage across the bias lines 163 of the block 156. As a result, this voltage appears across the anodes and cathodes of all of the PIN diode switches 150 of the unit cells 155. Since all of the PIN diode switches 150 will be closed or open in response, all of these unit cells 155 will have the same overall reactance.

Referring back to FIGS. 1 and 16, each grid 154 is aligned in the beam controller 101 of FIG. 1 so that the $E_C$-plane and the $H_L$-plane of each unit cell 155 of the grid 154 are respectively perpendicular to the $E_b$-plane and the $H_b$-plane of the beam 104. As mentioned earlier, the unit cells 155 in each block 156 will be controllably reconfigured by the control circuit 103 of FIG. 1 in the same way to have the same selected overall reactance for producing the same corresponding binary unit wide phase shift in the beam 104 in its $E_b$-plane or its $H_b$-plane. This is done by controlling the PIN diode switches 150 of FIG. 14 of the unit cells 155 in the block 156 to turn on or off their corresponding switching functions S of FIG. 13 so that the overall reactances of the unit cells 155 in the block 156 can all be made primarily inductive or primarily capacitive. The electric fields $E_C$ or the magnetic fields $H_L$ of the unit cells 147 in the column 151 are therefore all binarily changed in the same way to control the beam 104 in the same way in its $E_b$-plane or its $H_b$-plane. This results in a corresponding binary block wide phase shift in the $E_b$-plane or the $H_b$-plane.

By reconfiguring the unit cells 155 of blocks 156 of a grid 154 in this way, a corresponding discrete phase shift in the $E_b$-plane is achieved with the grid 154. If multiple grids 154 are used in the beam controller 100 of FIG. 1, the total phase shift in the $E_b$-plane or $H_b$-plane that occurs across the grids 154 comprises progressive discrete phase shifts.

As was discussed earlier for the grids 101 of FIG. 2, grouping the unit cells 155 of each grid 154 in blocks 156 has several advantages. It reduces phase coupling between adjacent unit cells 155, optimizes beam resolution, and simplifies the control circuit 103 of FIG. 1.

As with the unit cells 147 of the grids 146 and 152 of FIGS. 12 and 15, each unit cell 155 in each grid 152 could include the reconfigurable inductive and capacitive strips 106 and 107 of the unit cell 105 of FIG. 4 instead of the fixed inductive and capacitive strips 148 and 160. Similar to each unit cell 147 in this case, each unit cell 155 would be controllably reconfigurable by the control circuit 103 of FIG. 1 to have a selected overall reactance for producing a corresponding selected unit wide phase shift in the beam 104 in the $E_b$-plane or $H_b$-plane. But, by reconfiguring the unit cells 155 of each block 156 to have the same selected overall reactance, a corresponding selected block wide phase shift in the $E_b$-plane or the $H_b$-plane can therefore be achieved with each grid 154. Since this may be done with each block 156 of a grid 154, a corresponding selected continuous phase shift in the $E_b$-plane or the $H_b$-plane is achieved with the grid 154. If multiple grids 154 are used in the beam controller 100 of FIG. 1, the total phase shift in the $E_b$-plane or the $H_b$-plane that occurs across the grids 154 comprises progressive continuous phase shifts.

Fabrication Process

The grids 101, 146, and 154 may be fabricated using a three polysilicon layer process. This of course also means that the unit cells 105, 147, and 155 may each be formed with this same three polysilicon layer process. The composition of the various elements of these unit cells 105, 147, and 155 are identified in FIGS. 1 to 17 and therefore will not be specifically identified here.

In this process, a dielectric layer identified as dielectric layer 1 10 in FIGS. 1 to 17 is first deposited on a semiconductor substrate identified as substrate 109 in FIGS. 1 to 17. The substrate may comprise silicon and the insulating layer may comprise silicon nitride.

Then, a first polysilicon layer (poly 0) is deposited on the dieletric layer. This polysilicon layer is selectively patterned on the dielectric layer to form the elements identified in the FIGS. 1 to 17 as being poly 0.

A first sacrificial layer, such as a PSG (phosphorous silicate glass) like silicon dioxide, is then deposited on the dielectric layer and the patterned first polysilicon layer. This sacrificial layer is then selectively etched down to form openings for the formation of the elements identified as anchor 1 and 2. This sacrificial layer is also selectively etched to form dimples in it for the formation of contact rails.

A second polysilicon layer (poly 1) is then deposited on the first sacrificial layer and in the openings and dimples just mentioned. This polysilicon layer is then selectively patterned to form the elements identified as poly 1 and anchor 1 and the lower portions of the elements identified as anchor 2.

A first insulating layer (insulating 1) is then deposited on the first sacrificial layer and the patterned second polysilicon layer. Like the dielectric layer, this insulating layer may comprise silicon nitride. The first insulating layer is then selectively patterned to form the elements identified as insulating 1.

A second sacrificial layer that is of the same material as the first sacrificial layer is then deposited on the first sacrificial layer, the patterned second polysilicon layer, and the patterned first insulating layer. The second sacrificial layer is selectively etched down to the lower portions of the elements identified as anchor 2 for the formation of the upper portion of these elements. The second sacrificial layer is also selectively etched to provide openings for the formation of the elements identified as via. The second sacrificial layer is further selectively etched to form dimples in the second sacrificial layer for the formation of bushings of SDAs.

A third polysilicon layer (poly 2) is then deposited on the second sacrificial layer and in the openings and dimples just mentioned. This polysilicon layer is then selectively patterned to form the upper portions of the elements identified as anchor 2 and the elements identified as poly 2.

A third sacrificial layer is then deposited on the second sacrificial layer and the patterned third polysilicon layer. This third sacrificial layer is of the same material as the first and second sacrificial layers. This sacrificial layer is then selectively etched down to form openings for metal evaporation deposition of a metal layer, such as gold, on any of the elements identified as being poly 2 for which this is desired. Then, this metal layer is deposited.

Then, the first, second, and third sacrificial layers may be selectively etched to expose any elements identified as poly 0, poly 1, poly 2 for metal electroplating deposition of a metal layer, such as gold, on any of these elements for which it is desired and for those of the elements that are identified as electroplating. This is done by placing the entire grid 101, 146, or 154 or unit cell 105, 147, or 155 in a solution containing the metal and then applying an appropriate voltage to the exposed element.

Finally, the first, second, and third sacrificial layers are entirely removed. This frees all of the moving elements for movement in the manner described earlier.

Conclusion

As those skilled in the art will recognize the unit cells 105, 147, and 155, the grids 101, 146, and 154, and their various other embodiments described herein can be used in other quasi-optical systems. For example, they can be used in quasi-optical nonisotropitc filters, nonlinear surfaces, polarization rotators, impedance tuners, phase shifters, amplitude modulators, power splitters, front-end switching arrays, power linearizers, limiters, phase-locked loops, active feedback loops, etc.

Furthermore, while the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A quasi-optical unit cell for use in a quasi-optical grid to control an incident beam to the quasi-optical grid, the unit cell comprising:

an inductive conductive strip configured to provide an inductive reactance; and capacitive conductive strips to provide a capacitive reactance;

wherein at least one of the inductive strip and the capacitive strips are controllably reconfigurable to provide the unit cell with a variable overall reactance for producing a variable phase shift in the incident beam.

2. A quasi-optical grid for use in a quasi-optical system to control an incident beam to the quasi-optical system, the quasi-optical grid comprising quasi-optical unit cells, each of the quasi-optical unit cells comprising:

an inductive conductive strip configured to provide an inductive reactance; and capacitive conductive strips to provide a capacitive reactance;

wherein at least one of the inductive strip and the capacitive strips are controllably reconfigurable to provide the unit cell with a variable overall reactance for producing a variable phase shift in the incident beam.

3. A quasi-optical system for control an incident beam to the quasi-optical system, the quasi-optical system comprising:

quasi-optical grids, each of the quasi-optical grids comprising quasi-optical unit cells, each quasi-optical unit cell comprising an inductive conductive strip configured to provide an inductive reactance and capacitive conductive strips to provide a capacitive reactance; and a control circuit configured to controllably reconfigure at least one of the inductive strip and the capacitive strips to provide the unit cell with a variable overall reactance for producing a variable phase shift in the incident beam.

4. A quasi-optical unit cell for use in a quasi-optical grid to control an incident beam to the quasi-optical grid, the unit cell comprising:

an inductive conductive strip configured to provide an inductive reactance;

capacitive conductive strips configured to provide a capacitive reactance;

a switch configured to provide a switching function;

wherein:

the unit cell has an overall reactance in which the inductive reactance and the switching function are in series with each other and in parallel with the capacitive reactance, the overall reactance being primarily inductive or primarily capacitive when the switch is controlled so that the switching function is on or off; and the inductive and capacitive strips are configured so that the overall reactance causes a phase shift in but not an amplitude distortion in the incident beam.

5. A quasi-optical grid for use in a quasi-optical system to control an incident beam to the quasi-optical system, the quasi-optical grid comprising quasi-optical unit cells, each of the quasi-optical unit cells comprising:

an inductive conductive strip configured to provide an inductive reactance;

capacitive conductive strips configured to provide a capacitive reactance;

a switch configured to provide a switching function;

wherein:

the unit cell has an overall reactance in which the inductive reactance and the switching function are in series with each other and in parallel with the capacitive reactance, the overall reactance being primarily inductive or primarily capacitive when the switch is controlled so that the switching function is on or off, and the inductive and capacitive strips are configured so that the overall reactance causes a phase shift in but not an amplitude distortion in the incident beam.

6. A quasi-optical system for control an incident beam to the quasi-optical system, the quasi-optical system comprising:

quasi-optical grids, each of the quasi-optical grids comprising quasi-optical unit cells, each quasi-optical unit cell comprising an inductive conductive strip configured to provide an inductive reactance, capacitive conductive strips to provide a capacitive reactance, and a switch configured to provide a switching function, the unit cell having an overall reactance in which the inductive reactance and the switching function are in series with each other and in parallel with the capacitive reactance, the inductive and capacitive strips are configured so that the overall reactance causes a phase shift in but not an amplitude distortion in the incident beam; and a control circuit configured to control the switch to turn the switching function on or off to cause the overall reactance to be primarily inductive or primarily capacitive.

7. A quasi-optical unit cell for use in a quasi-optical grid to control an incident beam to the quasi-optical grid, the unit cell comprising:

a substrate having opposite first and second sides;

a first dielectric layer on the first side of the substrate;

a second dielectric layer on the second side of the substrate;

an inductive conductive strip on the first dielectric layer that is configured to provide an inductive reactance;

capacitive conductive strips on the second dielectric layer configured to provide a capacitive reactance;

a switch on the first dielectric layer that is configured to provide a switching function; wherein the unit cell has an overall reactance in which the inductive reactance and the switching function are in series with each other and in parallel with the capacitive reactance, the overall reactance being primarily inductive or primarily capacitive when the switch is controlled so that the switching function is on or off.

8. A quasi-optical grid for use in a quasi-optical system to control an incident beam to the quasi-optical system, the quasi-optical grid comprising quasi-optical unit cells, each of the quasi-optical unit cells comprising:

a substrate having opposite first and second sides;

a first dielectric layer on the first side of the substrate;

a second dielectric layer on the second side of the substrate;

an inductive conductive strip on the first dielectric layer that is configured to provide an inductive reactance;

capacitive conductive strips on the second dielectric layer configured to provide a capacitive reactance;

a switch on the first dielectric layer that is configured to provide a switching function; wherein the unit cell has an overall reactance in which the inductive reactance and the switching function are in series with each other and in parallel with the capacitive reactance, the overall reactance being primarily inductive or primarily capacitive when the switch is controlled so that the switching function is on or off, respectively.

9. A quasi-optical system for control an incident beam to the quasi-optical system, the quasi-optical system comprising:

quasi-optical grids, each of the quasi-optical grids comprising quasi-optical unit cells, each quasi-optical unit cell comprising:

a substrate having opposite first and second sides;

a first dielectric layer on the first side of the substrate;

a second dielectric layer on the second side of the substrate;

an inductive conductive strip on the first dielectric layer that is configured to provide an inductive reactance;

capacitive conductive strips on the second dielectric layer configured to provide a capacitive reactance;

a switch on the first dielectric layer that is configured to provide a switching function;

wherein the unit cell has an overall reactance in which the inductive reactance and the switching function are in series with each other and in parallel with the capacitive reactance; and a control circuit configured to control the switch to turn the switching function on or off to cause the overall reactance to be primarily inductive or primarily capacitive.

* * * * *